US007600627B2

(12) United States Patent
Ishikawa et al.

(10) Patent No.: US 7,600,627 B2
(45) Date of Patent: Oct. 13, 2009

(54) CONVEYOR APPARATUS

(75) Inventors: Yoshinobu Ishikawa, Hino (JP); Kenzo Tonoki, Tokyo-To (JP); Taihei Koyama, Hucyu (JP); Yoshio Ogimura, Tokyo-To (JP); Takayuki Kikuchi, Himeji (JP); Nobuhiro Oku, Himeji (JP); Shin Murakami, Hachioji (JP); Hitoshi Kawamoto, Tokyo-To (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 21 days.

(21) Appl. No.: 11/844,680

(22) Filed: Aug. 24, 2007

(65) Prior Publication Data

US 2008/0053788 A1 Mar. 6, 2008

(30) Foreign Application Priority Data

Aug. 31, 2006 (JP) ..... 2006-235636
Jul. 11, 2007 (JP) ..... 2007-182051

(51) Int. Cl.
*B66B 23/02* (2006.01)

(52) U.S. Cl. ..... 198/330; 198/333

(58) Field of Classification Search ..... 198/326, 198/330, 333

See application file for complete search history.

(56) References Cited

U.S. PATENT DOCUMENTS 3,677,388 A 7/1972 Boltrek et al.
4,082,173 A * 4/1978 Simon-Kochloffel ..... 198/330
6,427,823 B1 * 8/2002 Ishikawa et al. ..... 198/330
7,357,240 B2 * 4/2008 Ogimura et al. ..... 198/330
2005/0061609 A1 * 3/2005 Pietz ..... 198/330
2007/0235284 A1 10/2007 Ishikawa et al.

FOREIGN PATENT DOCUMENTS

| | | |
|---|---|---|
| JP | 47-10873 | 5/1972 |
| JP | 47-19989 | 11/1972 |
| JP | 2003-201084 | 7/2003 |
| JP | 2004-224567 | 8/2004 |
| JP | 2004-359367 | 12/2004 |

* cited by examiner

*Primary Examiner*—James R Bidwell
(74) *Attorney, Agent, or Firm*—Oblon, Spivak, McClelland, Maier & Neustadt, P.C.

(57) ABSTRACT

A conveyor apparatus is provided that is free of a pulsing motion in the circulating chains so as to provide a comfortable ride quality on its steps. The conveyor apparatus includes a step guide rail, a plurality of steps, a step chain, and a chain driving mechanism for driving the step chain. The chain driving mechanism includes a rotating and driving unit, a driving sprocket which is rotated by a driving force given by the rotating and driving unit, and a circulating chain for giving a thrust to the step chain. The circulating chain has chain links and hinges that are to be connected to the adjacent chain links. The chain link includes a placing surface on which the step roller is placed, and pressing surfaces that are in contact with step rollers.

20 Claims, 16 Drawing Sheets

CONVEYOR APPARATUS

CROSS REFERENCE TO PRIOR APPLICATION

This application claims priority from Japanese Patent Application No. 2006-235636 filed on Aug. 31, 2006, and Japanese Patent Application No. 2007-182051 filed on Jul. 11, 2007. The entire contents of this application are incorporated herein by reference.

FIELD OF THE INVENTION

The present invention relates to a conveyor such an escalator and a moving walkway. More particularly, it pertains to a conveyor apparatus free of pulsing motion in circulating chains to provide a comfortable ride quality on steps.

BACKGROUND ART

A conveyor such as an escalator and a moving platform includes a plurality of steps each having guide rollers on front and rear sides. These steps are supported by the guide rollers that are engaged with step guide rails provided in a structure, and the steps are circulated between an entrance port and an exit port, while horizontal postures of the steps are maintained. The steps are generally connected to each other by means of a step chain. By driving the step chain, all the steps are configured to be synchronically moved without generating a gap therebetween.

The step chain is driven by a driving mechanism which is generally of a type for driving chain ends by sprockets. In general, such a driving mechanism is disposed near an entrance port or an exit port. However, in a conveyor in which a travel distance of the steps are long, there is a possibility that a sufficient driving force cannot be transmitted by only the driving mechanism disposed on the chain end, because of an increased load applied to the step chain. Thus, in a conveyor in which a travel distance of the steps are long, it has been proposed to arrange a plurality of driving mechanisms to give a driving force at intermediate positions (a position other than an end at which the chain turns by changing directions) of a long chain (see, Patent Documents 2 and 3, for example).

The driving mechanism for giving a driving force at an intermediate position of a chain in a conveyor generally includes a motor as a driving force source, a reduction gear for amplifying a driving force by a factor of 10 or more, and a chain driving force transmitting mechanism for transmitting a driving force to a linearly extended step chain. When a sprocket is used as the chain driving force transmitting mechanism, a meshing rate is decreased because the linear chain is not wound round the sprocket. Thus, there is used a chain driving force transmitting mechanism shown in FIGS. 16(*a*) and 16(*b*).

As shown in FIGS. 16(*a*) and 16(*b*), in a driving force transmitting mechanism 100, a step chain for connecting steps 101 is formed as a tooth chain 102 of a long link length, and the tooth chain 102 is driven by rotating circulating chain 104 provided with pin rollers 103.

[Patent Document 1] JP2004-224567A

[Patent Document 2] JP47-19989U

[Patent Document 3] JP47-10873A

However, when such a tooth chain 102 of a long link length is used as a step chain, a speed irregularity may easily occur, as compared with a general step chain, at an end of the conveyor where the tooth chain 102 turns to change directions. Thus, it is difficult to invert the steps 101 with the use of a circular sprocket which is uniformly rotated. Thus, when the tooth chain 102 is used as a step chain, a guide rail of a pseudo-circular shape has to be used to invert the tooth chain 102. As a result, a driving mechanism using an inexpensive and general sprocket is difficult to be used as a driving mechanism for driving a step chain.

As a driving mechanism for giving a driving force at an intermediate position of a conveyor apparatus, a driving mechanism of a type that is capable of driving a generally used step chain is preferred.

However, a general step chain is of a short link length, so that a sufficient meshing angle cannot be guaranteed to drive circulating chain in circulation. Thus, it is necessary to dispose a mechanism for preventing a step chain from floating.

In a conveyor apparatus in which a conveyor chain of relatively a long link is used as a step chain, contrivances in shape is necessary, e.g., a link length of circulating chain is increased to be equal to or more than the link length of the step chain, in order to make deeper a meshing angle of the circulating chain relative to the step chain.

However, in a driving mechanism disposed at an intermediate position of a conveyor apparatus, when circulating chain whose link length is equal to or larger than that of a conveyor chain is driven in circulation by a general sprocket, the number of teeth of the sprocket is not enough. Thus, pulsing motions occur in the circulating chains and the step chain to thereby impair a ride quality of a step.

In addition, even when a link of the circulating chain is elongated to allow contrivances in shape, since a concrete shape for making deeper a meshing has not been disclosed heretofore, such a shape must be additionally invented.

The present invention has been made in view of the above disadvantages. The object of the present invention is to provide a conveyor apparatus including a driving mechanism for giving a driving force at an intermediate position of the conveyor apparatus, the conveyor apparatus being capable of giving a driving force to a general step chain while achieving a sufficient meshing angle. In particular, the object of the present invention is to provide a conveyor apparatus free of pulsing motion in circulating chain to provide a comfortable ride quality on steps, even when a conveyor chain of relatively a long link is used as a step chain and the circulating chain of a long link to be engageable with the step chain is driven by a general sprocket.

Means for Solving the Problem

The present invention is a conveyor apparatus comprising: a step guide rail; a plurality of steps that move along the step guide rail; a step chain for connecting the steps; and a chain driving mechanism for driving the step chain; wherein the step chain has a plurality of step links and step rollers between the adjacent step links, and the chain driving mechanism includes: a rotating and driving unit; a driving sprocket connected to the rotating and driving unit to be rotated by a driving force given by the rotating and driving unit; and circulating chain disposed between the driving sprocket and the step chain to be circulated in accordance with a rotational movement of the driving sprocket to give a thrust to the step chain; the circulating chain has chain links and hinges to be connected to the adjacent chain links, a pitch length of the chain link being equal to or a multiple of a pitch length of the step link; and the chain link has a placing surface on which the step roller is placed, and pressing surfaces that are in contact with the step rollers on front and rear sides of the step roller placed on the placing surface.

According to the present invention, even when a general step chain is driven, the rotating and driving unit can give a driving force thereto while maintaining a deep meshing angle.

The present invention is the conveyor apparatus wherein the chain link has a shape that bypasses the step roller when the step roller is placed on the placing surface.

According to the present invention, the rotating and driving unit can give a driving force while maintaining a deeper meshing angle.

The present invention is the conveyor apparatus wherein chain rollers are arranged on each of the hinges of the circulating chain such that the chain rollers are coaxially rotatable with the hinges; a rail for circulation is disposed that is engaged with the chain rollers for guiding the circulating chain along a circulation path; and the rail for circulation defines a path formed by a pair of arcuate parts and at least one linear part, and inclined surfaces as connecting parts for preventing vibrations of the circulating chain are interposed between the respective arcuate parts and the linear part.

According to the present invention, even when a conveyor chain of relatively a long link is used as a step chain and circulating chain of a long link to be engageable with the step chain is driven by a general sprocket, the circulating chain and the step chain can be free of pulsing motion, so that a comfortable ride quality on the steps can be provided.

The present invention is the conveyor apparatus wherein a driven sprocket as a counterpart of the driving sprocket is rotatably disposed on one arcuate part of the rail for circulation.

According to the present invention, movements of the right and left circulating chains can be synchronized.

The present invention is the conveyor apparatus wherein a sectoral part of a larger curvature radius is formed on a path at a position of the step chain where the chain driving mechanism is disposed, and the rail for circulation includes a pair of arcuate parts, a linear part, and an arcuate part of a larger diameter having a shape corresponding to the sectoral part, and inclined surfaces as connecting parts for preventing vibrations of the circulating chain are interposed between the respective arcuate parts and the linear part, and between the respective arcuate part and the arcuate part of a larger diameter.

According to the present invention, since the step chain is pressed against an inside of the sectoral part by a tensile force of the step chain, a mechanism for preventing floating of the step chain is dispensable.

The present invention is the conveyor apparatus further comprising a handrail belt driving unit for driving a handrail belt, wherein a coupling mechanism for transmitting a driving force from the driven sprocket is disposed between the driven sprocket and the handrail belt driving unit.

According to the present invention, a handrail belt can be driven in conjunction with the steps.

The present invention is the conveyor apparatus wherein the chain rollers are disposed on right and left sides of the chain link, and the rails for circulation on which the chain rollers are rotated are disposed on right and left sides of the circulating chain corresponding to the layout of the chain link.

According to the present invention, the circulating chain is guided and supported along the right and left chain rollers along the rails for circulation, so that the circulating chain can be circulated in a stable state.

The present invention is the conveyor apparatus wherein one of the chain rollers is positioned such that the one chain roller overlaps with the step chain, while the other of the chain rollers is positioned such that the other chain roller is positioned outside a projection plane of the step chain so as not to overlap with the same.

According to the present invention, the circulating chain can be meshed with the step chain at a deep meshing angle.

The present invention is the conveyor apparatus wherein the rotating and driving unit includes a driving motor, a reduction gear for amplifying a rotational torque of the driving motor, and transmitting mechanisms for transmitting the amplified rotational torque to the respective right and left driving sprockets.

According to the present invention, since the number of the reduction gear can be reduced to one, the rotating and driving unit can have a simple structure and can be made at low costs. At the same time, assemblage and maintenance of the rotating and driving unit can be made easier.

The present invention is the conveyor apparatus wherein the rotating and driving unit includes a driving motor, a transmitting mechanism for transmitting a rotational torque of the driving motor to the respective right and left driving sprockets, and reduction gears disposed on a center of each driving sprocket for amplifying a rotational torque transmitted by the transmitting mechanism.

According to the present invention, a torque transmitted from the driving motor to the transmitting mechanism is small, and a size is small. Thus, the rotating and driving unit can be disposed between the circulating steps, and can be made smaller.

The present invention is the conveyor apparatus wherein the driving sprocket and the driven sprocket each have a shape engageable with the chain links of the circulating chain.

According to the present invention, since the driving sprocket and the driven sprocket each have a shape engageable with the chain links of the circulating chain, the chain rollers are not involved in a meshing of the driving sprocket and the driven sprocket with the circulating chain, and the circulating chain can be circulated in a stable state while the chain rollers are supported by the rail for circulation throughout its path.

The present invention is the conveyor apparatus wherein each of the circulating chain has the even number of hinges, with the chain links of the circulating chain being overlappingly connected to each other in a staggered manner, and the driving sprocket and the driven sprocket are formed by overlapping plate teeth each having substantially the same thickness as that of the chain link, with the respective plate teeth being configured to be sequentially, alternately engaged with the chain links.

According to the present invention, the thinner circulating chain can be made with the thicknesses of the chain links so as to save space.

The present invention is a conveyor apparatus comprising: a step guide rail; a plurality of steps that move along the step guide rail; a step chain including a plurality of step rollers rotating on the step guide rail and a plurality of step links disposed between the respective step rollers, the step chain connecting the steps by the certain step rollers positioned at every predetermined number of the step rollers such that the certain step rollers are engaged with the steps; and a chain driving mechanism including a rotating and driving unit; a driving sprocket and a driven sprocket that are rotated by a driving force given by the rotating and driving unit, and a circulating chain disposed between the driving sprocket and the driven sprocket and the step chain to be circulated in accordance with a rotational movement of the driving sprocket and the driven sprocket to give a thrust to the step chain; wherein the circulating chain has a plurality of chain links whose pitch length is equal to or a multiple of a pitch length of the step link, and hinges for connecting the chain links, each of the chain links has a placing surface on which the step roller is placed, the placing surface being formed into a curved shape corresponding to a circumferential shape of the step roller, and pressing surfaces that are in contact with the step rollers on front and rear sides of the step roller placed on the placing surface; and the number of the chain links is different from a multiple of the predetermined number as a positioning cycle number of the certain step rollers to be engaged with the steps.

The present invention is the conveyor apparatus wherein the chain driving mechanism is provided with a tensioner mechanism that moves the driven sprocket in a direction close to and apart from the driving sprocket to adjust a tensile force of the circulating chain.

The present invention is the conveyor apparatus herein the circulating chain of the chain driving mechanism have chain rollers coaxially rotatable with the hinges, a rail for circulation that is engaged with the chain rollers of the circulating chain to guide the circulating chain along a circulation path is disposed; and the tensioner mechanism moves a part of the rail for circulation along with the driven sprocket to adjust a tensile force of the circulating chain.

The present invention is the conveyor apparatus wherein the respective driving sprocket and the driven sprocket of the chain driving mechanism have tooth spaces to be engaged with the chain links of the circulating chain, and the respective tooth spaces have margin gaps for promoting disengagement of the chain links.

The present invention is conveyor apparatus the respective driving sprocket and the driven sprocket of the chain driving mechanism are formed by overlapping a plurality of plate teeth provided with tooth spaces to be engaged with the chain links of the circulating chain, common holes passing in a thickness direction are formed at positions where the tooth spaces of the respective plate teeth intersect with each other, and a buffer material is buried in the common holes.

The present invention is conveyor apparatus wherein, at a start position and a finish position of a thrust transmitting region where the circulating chain of the chain driving mechanism travel side by side with the step chain to give a thrust thereto, a load applied to the step chain is shared and supported by both the step guide rail and the circulating chain.

The present invention is conveyor apparatus, at the start position and the finish position of the thrust transmitting region, an assisting rail to be in contact with the step links of the step chain to support a part of a load to be applied to the step chain is disposed on the step guide rail.

The present invention is the conveyor apparatus wherein, in the thrust transmitting region, the step rollers of the step chain are separated from the step guide rail.

According to the present invention, even when a general step chain is driven, the step chain can be appropriately driven while maintaining a deep meshing. Further, local abrasion of the circulating chains can be prevented to provide a comfortable ride quality on the steps.

BEST MODE FOR CARRYING OUT THE INVENTION

First Embodiment

A first embodiment of the present invention is described below with reference to FIGS. 1 to 10.

Figure 1:
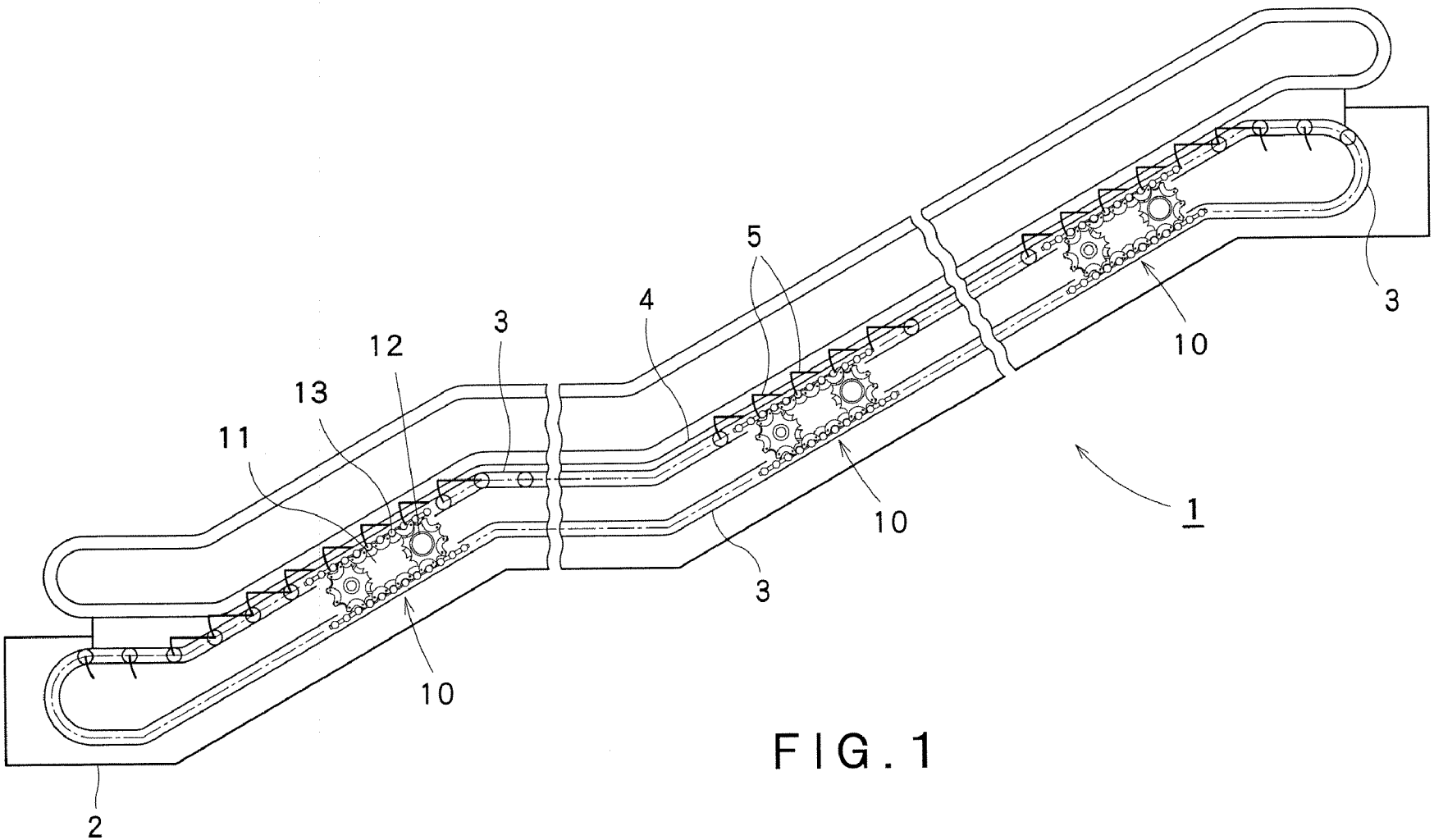
FIG. 1 is a side view of a conveyor apparatus in a first embodiment of the present invention.
Figure 2:
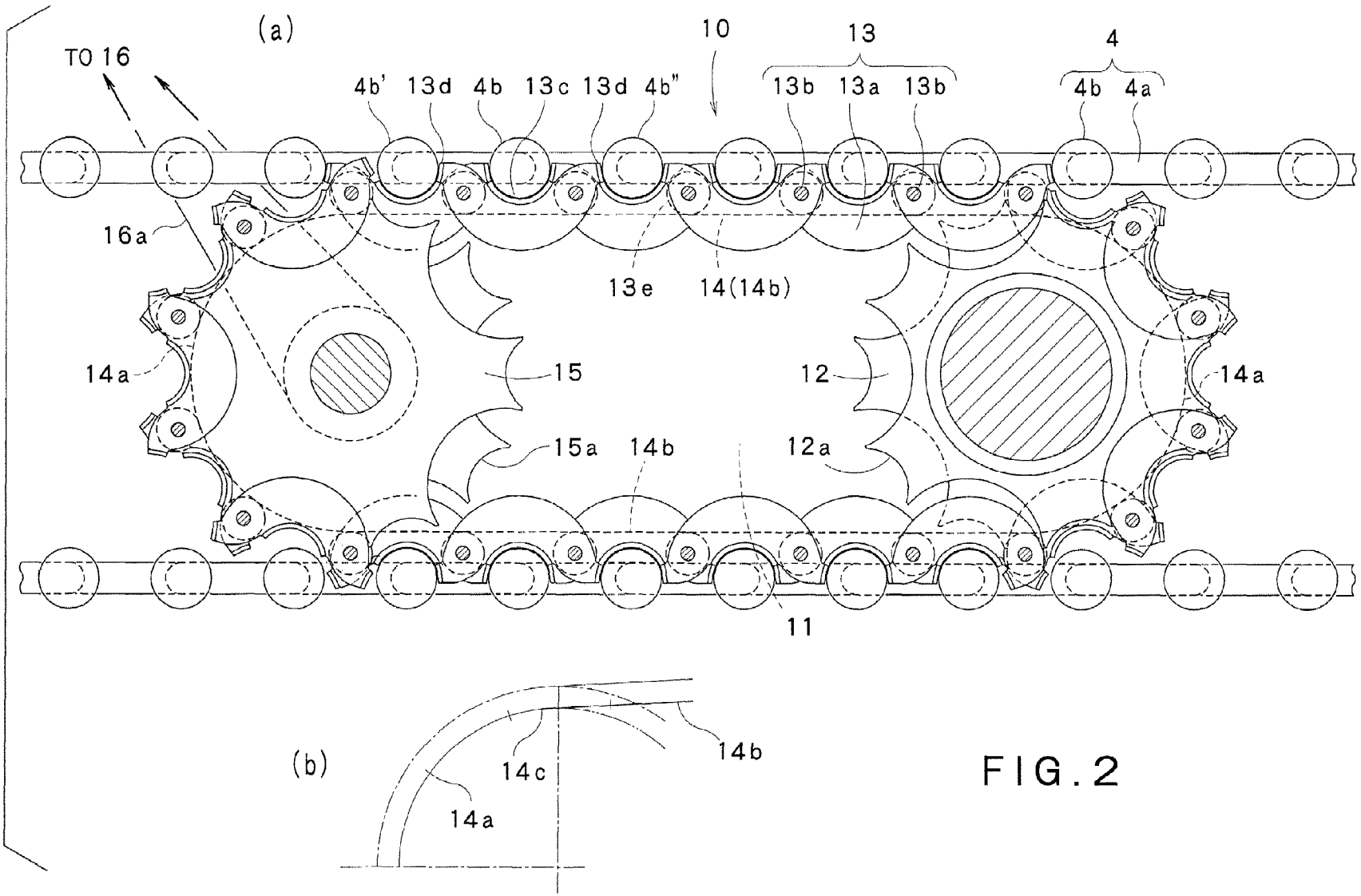
FIG. 2 is a side view of a chain driving mechanism of the conveyor apparatus in the first embodiment of the present invention.
Figure 3:
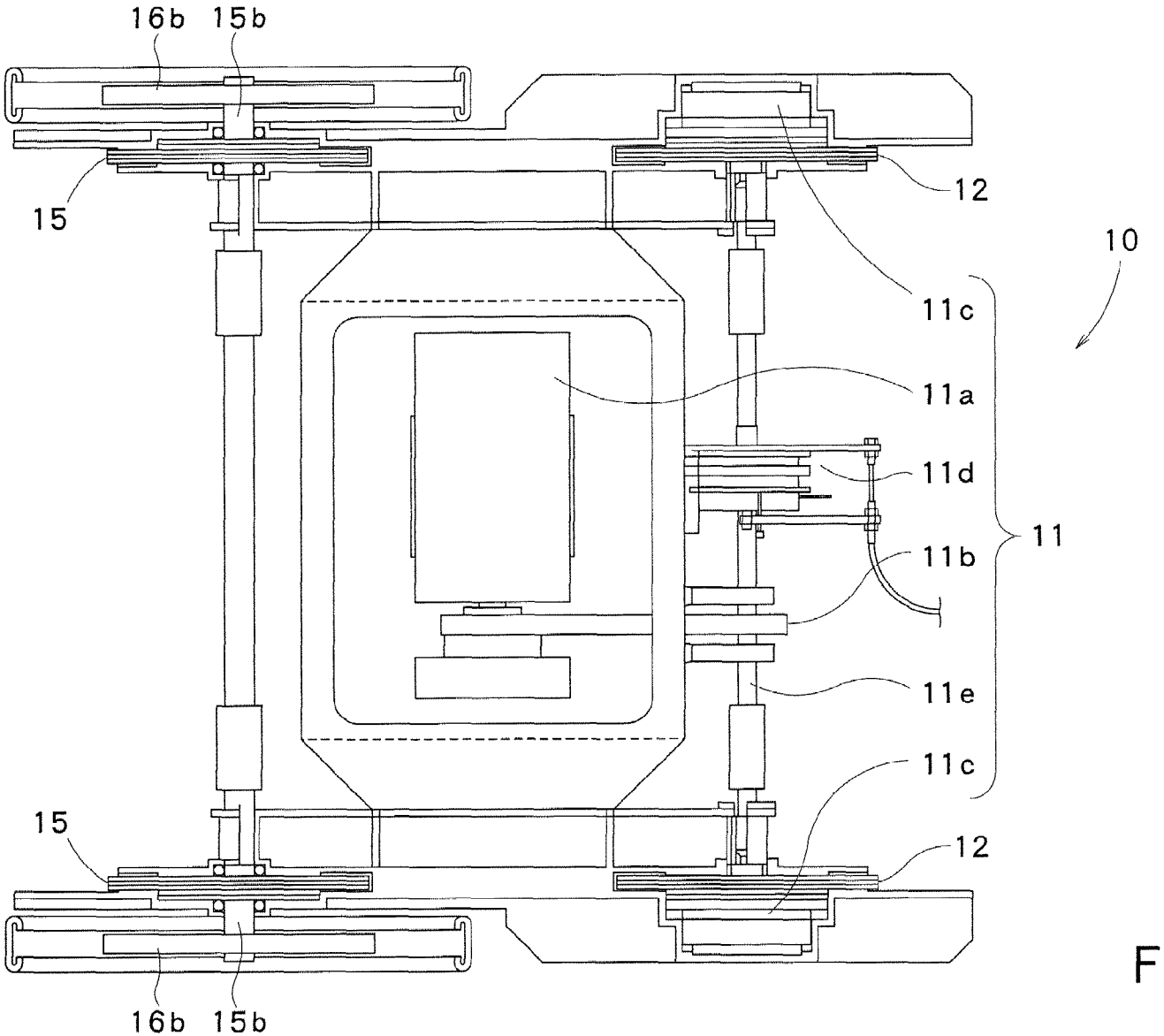
FIG. 3 is a plan view of the chain driving mechanism of the conveyor apparatus in the first embodiment of the present invention.
Figure 4:
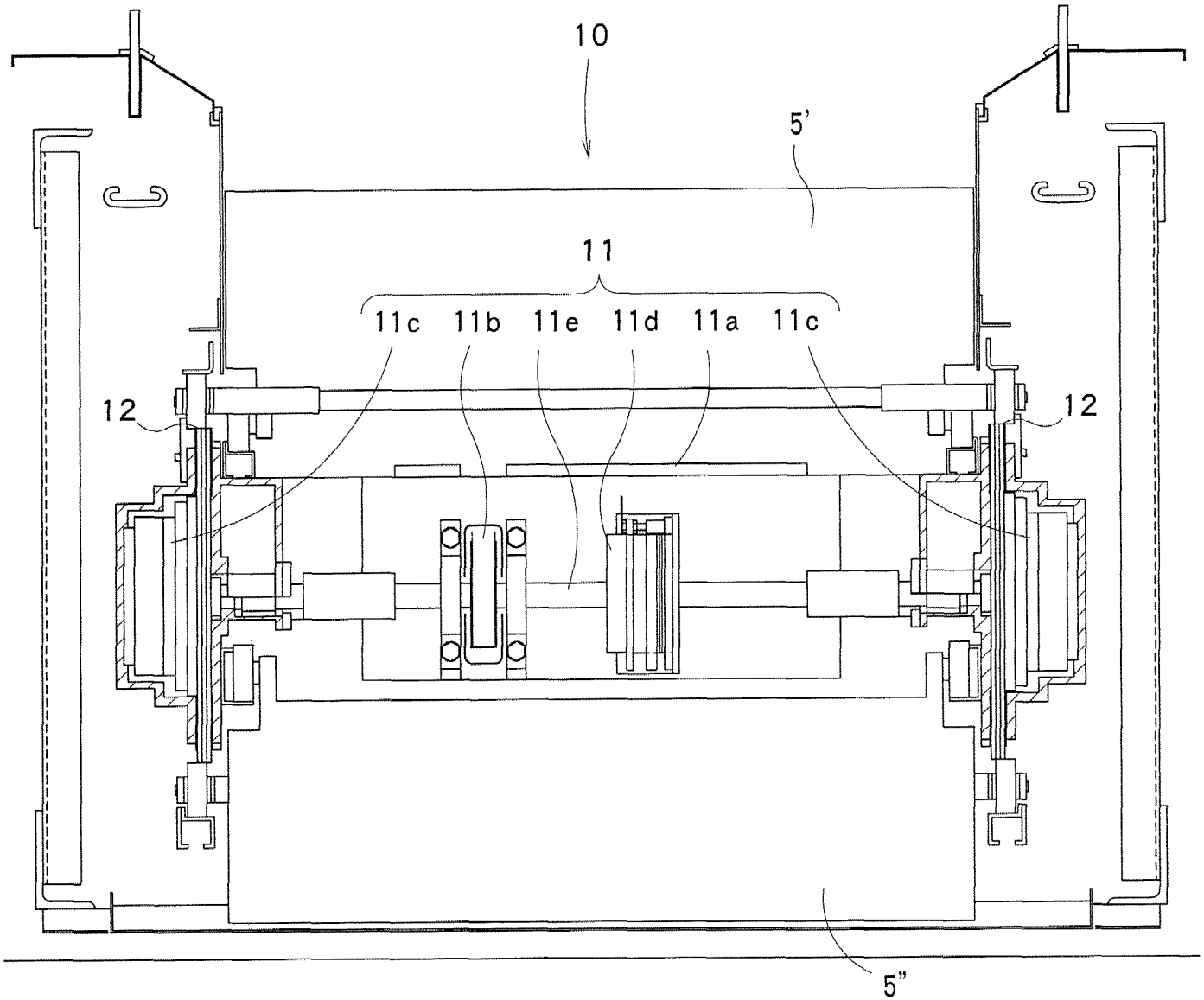
FIG. 4 is a front sectional view of the chain driving mechanism of the conveyor apparatus in the first embodiment of the present invention.
Figure 5:
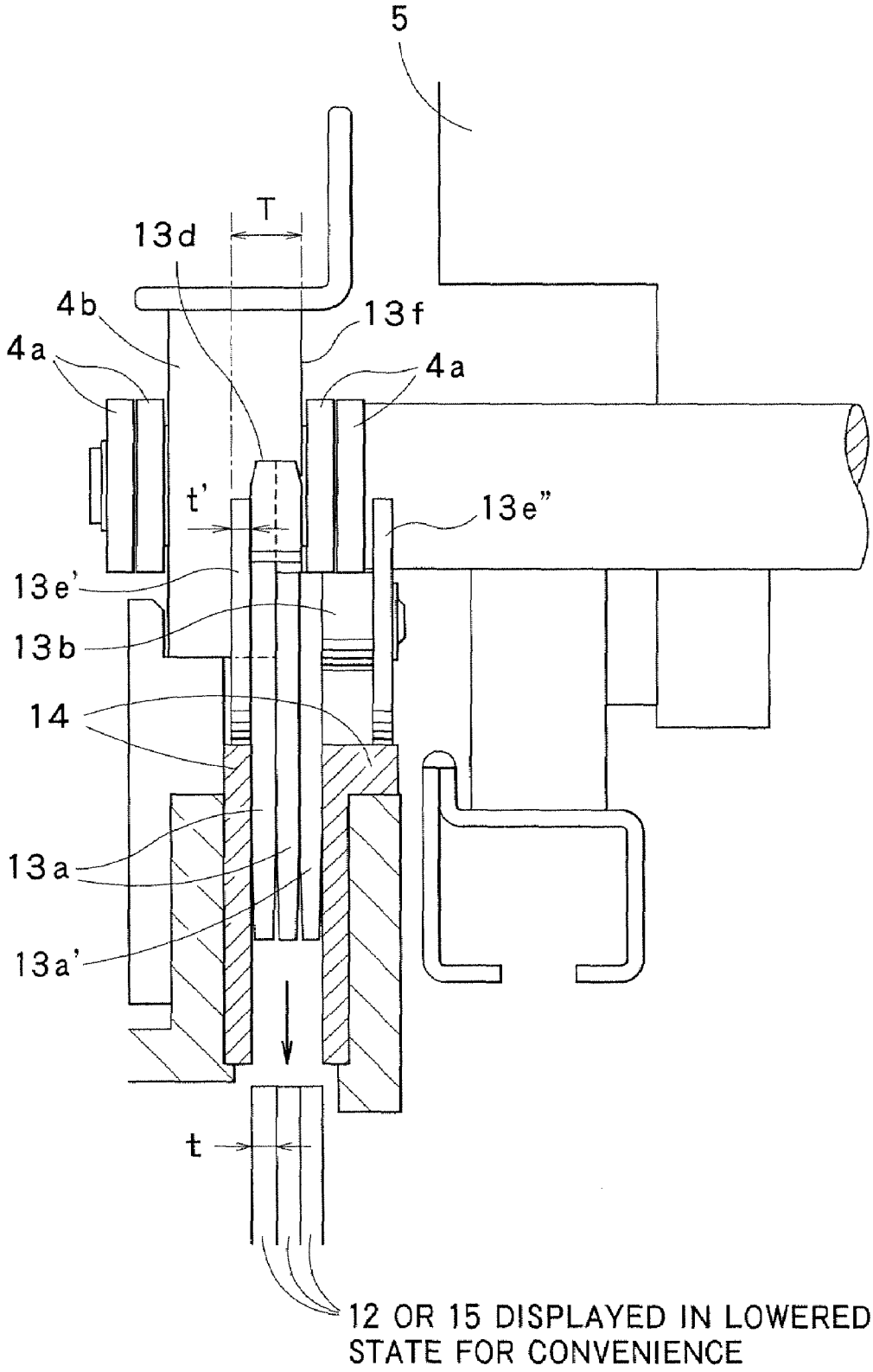
FIG. 5 is front sectional view of a circulating chain of the chain driving mechanism of the conveyor apparatus in the first embodiment of the present invention.
Figure 6:
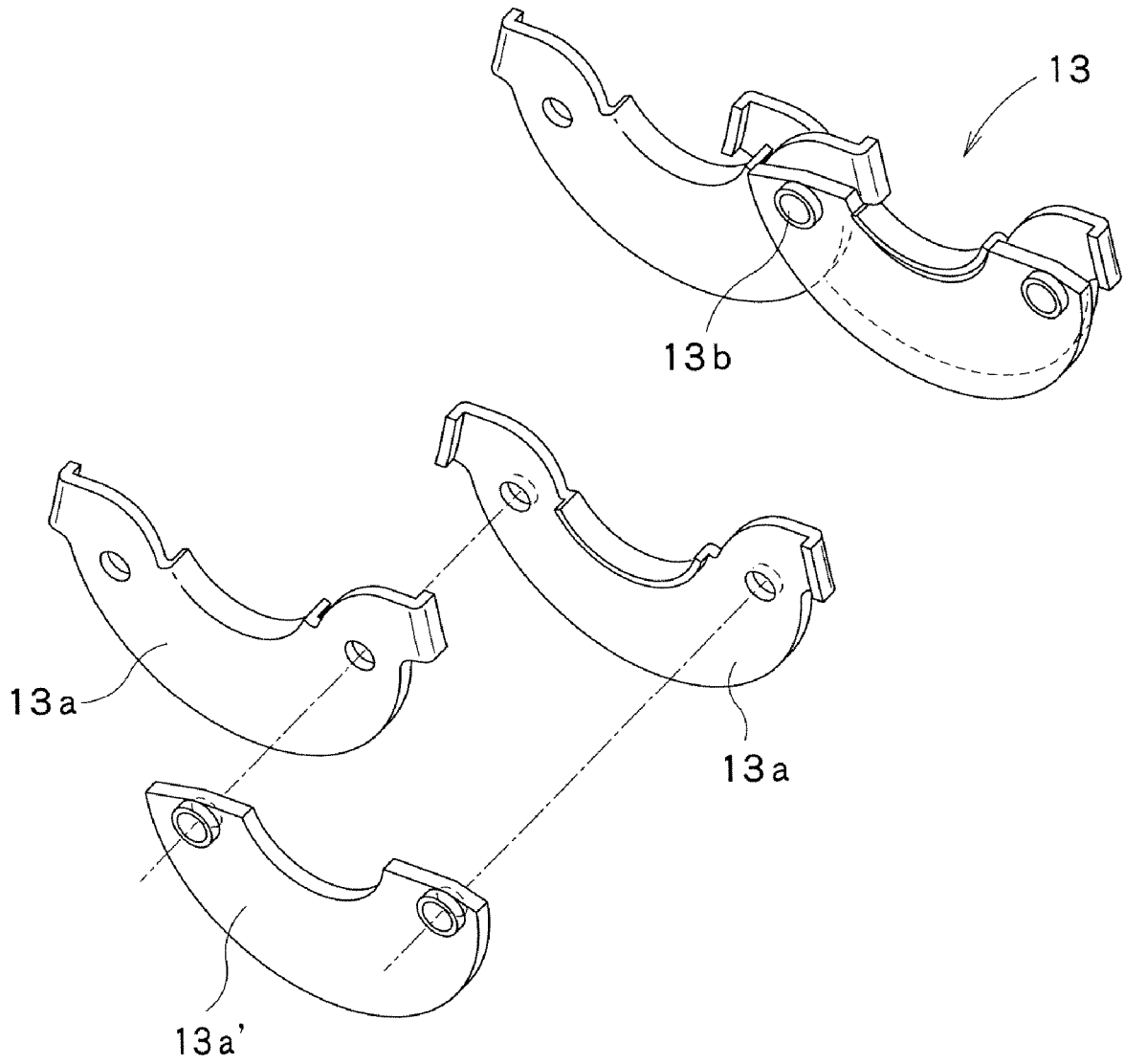
FIG. 6 is a perspective view of a part of the circulating chain of the chain driving mechanism of the conveyor apparatus in the first embodiment of the present invention.
Figure 7:
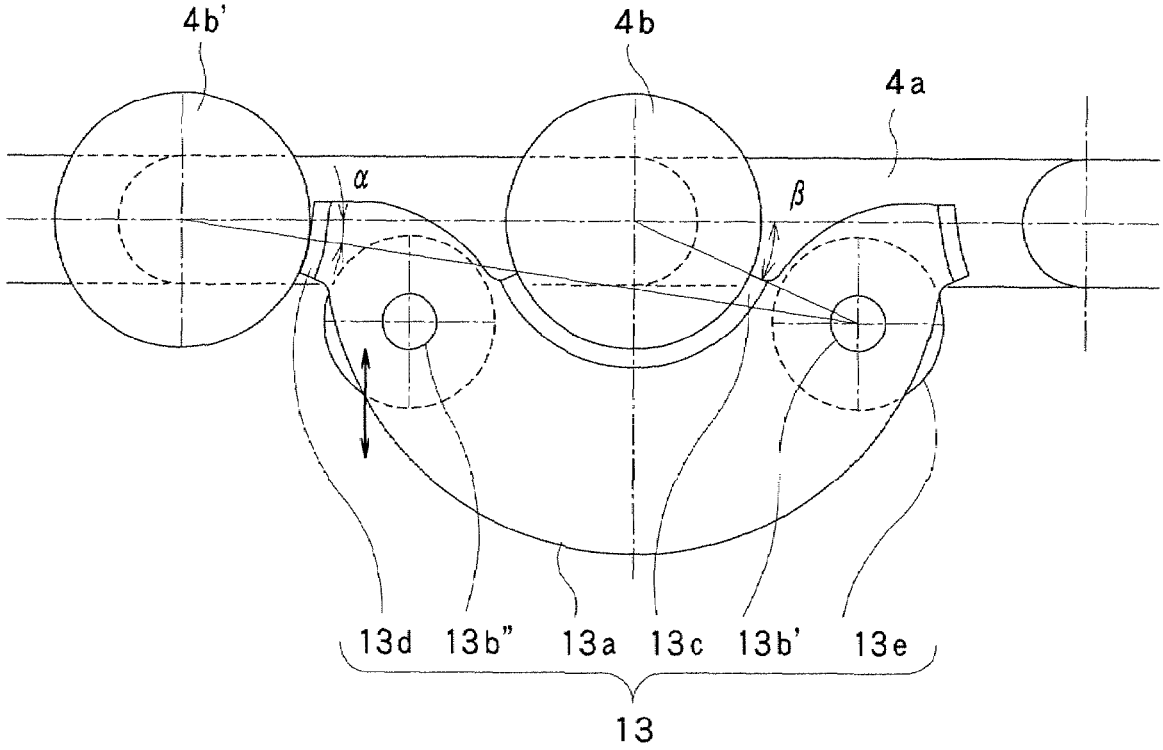
FIG. 7 is a view illustrating a shape and an operation of the circulating chain of the chain driving mechanism of the conveyor apparatus in the first embodiment of the present invention.
Figure 8:
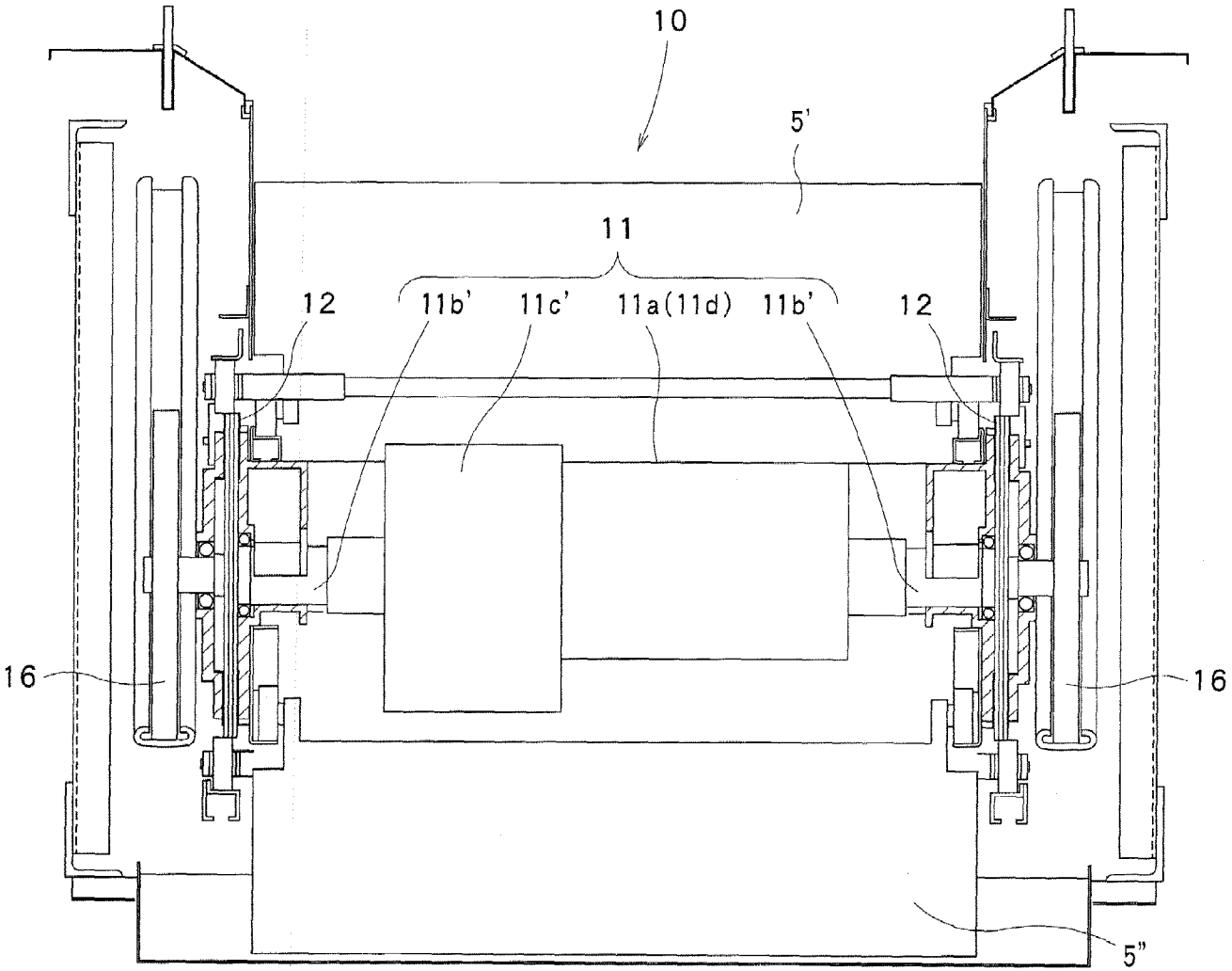
FIG. 8 is a plan view of another chain driving mechanism different from the chain driving mechanism shown in FIGS. 3 and 4.
Figure 9:
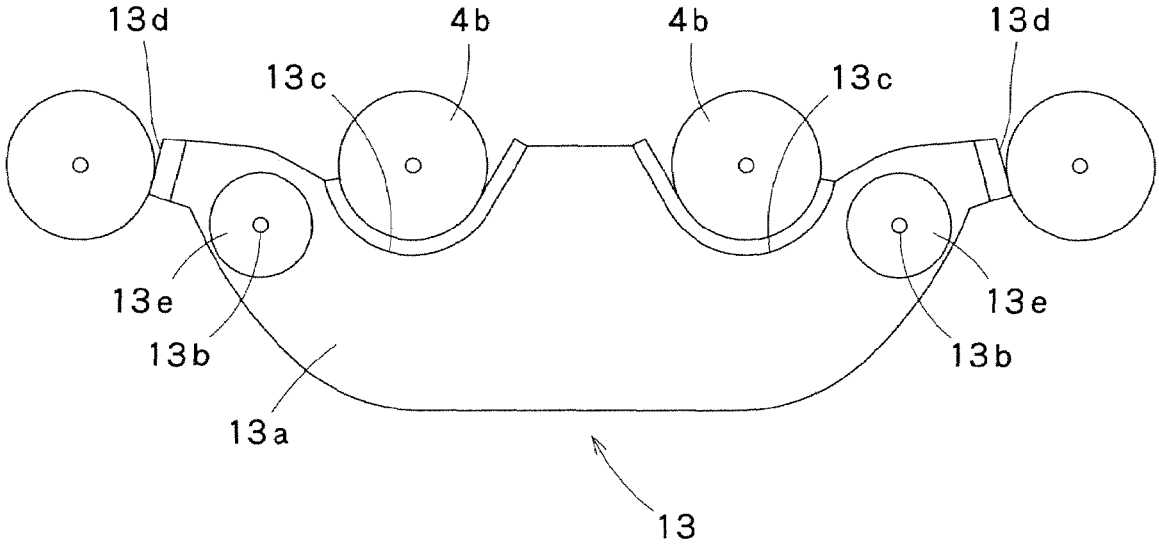
FIG. 9 is a view of a circulating chain in which a pitch length of a chain link is twice a pitch length of a step link.
Figure 10:
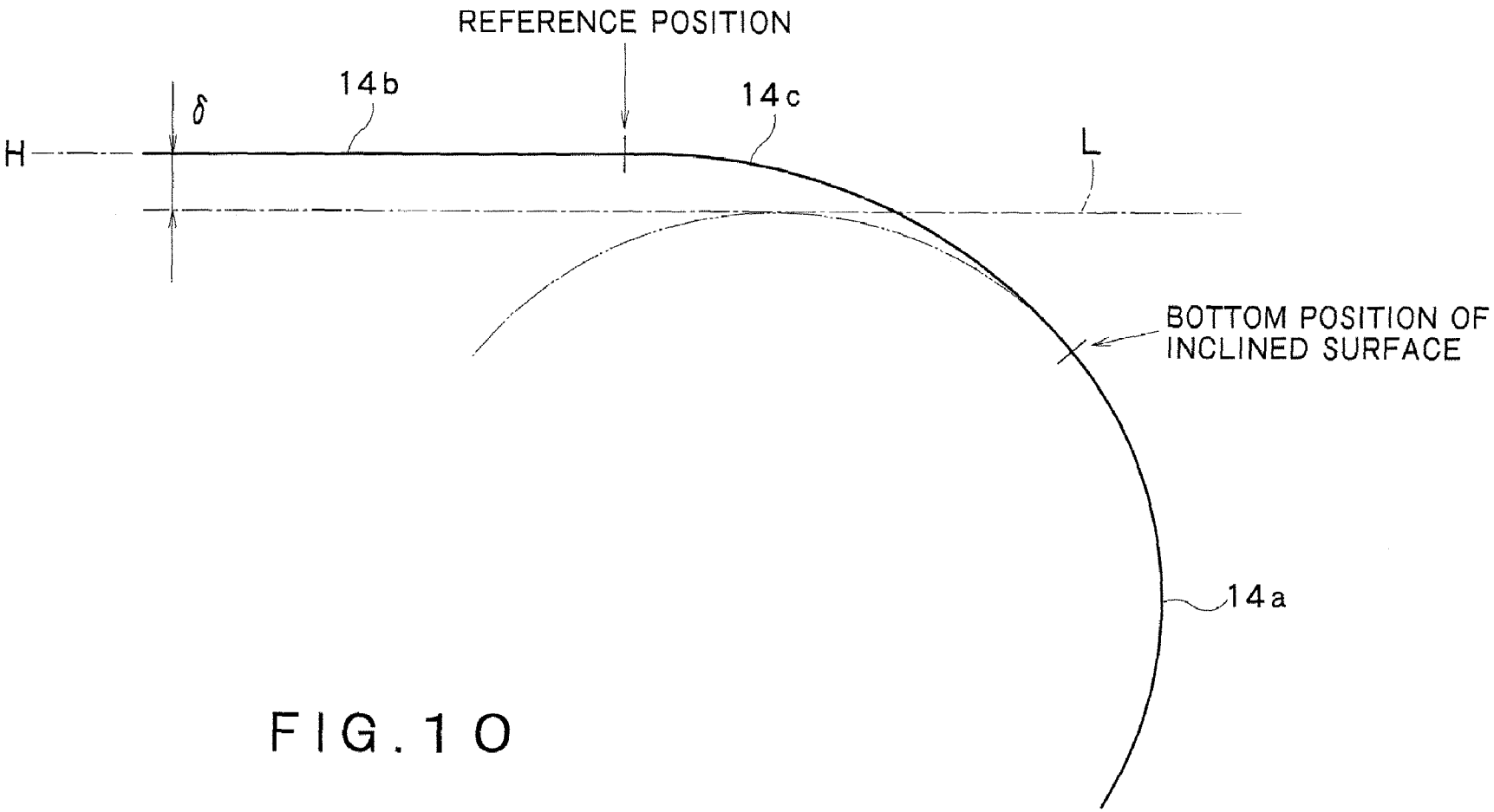
FIG. 10 is an enlarged view of a part of a rail for circulation.

FIG. 1 is a side view of a conveyor apparatus in a first embodiment of the present invention. FIGS. 2(*a*) and 2(*b*) are side views of a chain driving mechanism of the conveyor apparatus in the first embodiment of the present invention. FIG. 3 is a plan view of the chain driving mechanism of the conveyor apparatus in the first embodiment of the present invention. FIG. 4 is a front sectional view of the chain driving mechanism of the conveyor apparatus in the first embodiment of the present invention. FIG. 5 is front sectional view of a circulating chain of the chain driving mechanism of the conveyor apparatus in the first embodiment of the present invention. FIG. 6 is a perspective view of a part of the circulating chain of the chain driving mechanism of the conveyor apparatus in the first embodiment of the present invention. FIG. 7 is a view illustrating a shape and an operation of the circulating chain of the chain driving mechanism of the conveyor apparatus in the first embodiment of the present invention. FIG. 8 is a plan view of another chain driving mechanism different from the chain driving mechanism shown in FIGS. 3 and 4. FIG. 9 is a view of a circulating chain in which a pitch length of a chain link is twice a pitch length of a step link. FIG. 10 is an enlarged view of a part of a rail for circulation.

At first, a schematic structure of the conveyor apparatus in this embodiment is described with reference to FIG. 1 and FIGS. 2(*a*) and 2(*b*).

As shown in FIG. 1, a conveyor apparatus 1 includes a step guide rail 3 mounted on a structure 2, a plurality of steps 5 that move along the step guide rail 3, a step chain 4 for connecting the steps 5, and a chain driving mechanism 10 for driving the step chain 4.

As shown in FIG. 2, the step chain 4 has step links 4*a* and step rollers 4*b*. The step rollers 4*b* are rollers that rotate on the step guide rail 3. Each step link 4*a* is disposed between the adjacent step rollers 4*b*. Since the certain step rollers positioned at every predetermined number of the step rollers 4*b* are respectively engaged with the steps 5, the step chain 4 connects the steps 5.

As shown in FIG. 2(*a*) and FIG. 3, the chain driving mechanism 10 includes a rotating and driving unit 11, a pair of driving sprockets 12 connected to the rotating and driving unit 11 to be rotated by a driving force given by the rotating and driving unit 11, a pair of driven sprockets 15 which are counterparts of the driving sprocket 12 and are rotated together with the driving sprockets 12, and a pair of circulating chains 13 going around the driving sprockets 12 and the driven sprocket 15 to be circulated. Each of the circulating chains 13 is disposed between the driving sprocket 12 and the driven sprocket 15 and the step chain 4, and is circulated in accordance with a rotational movement of the driving sprocket 12 and the driven sprocket 15 to give a thrust to the step chain 4.

Each of the circulating chains 13 has the plurality of chain links 13*a* and hinges 13*b* to be connected to the adjacent chain links 13*a*. A pitch length of the chain link 13*a* is equal to a pitch length of the step link 4*a*. Alternatively, as shown in FIG. 9, the pitch length of the chain link 13*a* may be a multiple of the pitch length of the step link 4*a* (two times in FIG. 9).

In addition, the chain link 13*a* includes a placing surface 13*c* on which the step roller 4*b* is placed, and pressing surfaces 13*d* and 13*d* that are in contact with step rollers 4*b*' and 4*b*" which are positioned on front and rear sides (right and left sides in FIG. 2) of the step roller 4*b* placed on the placing surface 13*c*. The placing surface 13*c* of the chain link 13*a* is formed into a curved shape corresponding to a circumferential surface of the step roller 4*b*. The chain link 13 has a shape that bypasses the step roller 4*b* (a shape that do not interfere with the step roller 4*b*), when the step roller 4*b* is placed on the placing surface 13*c*.

As shown in FIGS. 2(*a*) and 2(*b*), chain rollers 13*e* are arranged on each of the hinges 13*b* of the circulating chain 13 such that the chain rollers 13*e* are coaxially rotatable with the hinges 13*b*. A rail for circulation 14 which is engaged with the chain rollers 13*e* for guiding the circulating chain 13 along a circulation path. The rail for circulation 14 defines a path formed by a pair of arcuate parts 14*a* and 14*a* and a pair of linear parts 14*b* and 14*b*. Inclined surfaces 14*c* as connecting parts for preventing vibrations of the circulating chain 13 are interposed between the respective arcuate parts 14*a* and linear parts 14*b* (see, FIGS. 2(*b*) and 10).

As shown in FIG. 10, a height position H in a horizontal plane of the linear part 14*b* of the rail for circulation 14 is set at a position obtained by adding a predetermined offset amount δ to a tangent L of the driving sprocket 12 which is parallel to the horizontal plane H. The inclined surface 14*c* as a curved connection part is formed on an end of the linear part 14*b* to which the driving sprocket 12 is introduced. As shown in FIG. 10, the inclined surface 14*c* is in contact with the linear part 14*b* at a reference position, and in contact with the arcuate part 14*a* at a bottom position of the inclined surface (see, Patent Document 1 for details).

As shown in FIG. 2(*a*), the driven sprocket 15 which is a counterpart of the driving sprocket 12 is rotatably disposed on one arcuate part 14*a* of the rail for circulation 14. There is a handrail belt driving unit 16 for driving a handrail belt. A coupling mechanism 16*a* for transmitting a driving force from a shaft 15*b* of the driven sprocket 15 is disposed between the driven sprocket 15 and the handrail belt driving unit 16. The handrail belt driving unit 16 drives a not-shown handrail belt, which is clamped by a plurality of rollers, by a driving force obtained from the driven sprocket 15.

Alternatively, as shown in FIG. 3, the handrail belt may be directly driven by a roller 16*b* of a larger diameter of the handrail belt driving unit 16 by a driving force obtained from the shaft 15*b* of the driven sprocket 15.

As shown in FIGS. 3 and 4, the rotating and driving unit 11 includes a driving motor 11*a*, a transmitting mechanism 11*b* formed of a belt for transmitting a rotational torque of the driving motor 11*a* to the respective right and left driving sprockets 12, and reduction gears 11*c* disposed on a center of each driving sprocket 12 for amplifying a rotational torque transmitted by the transmitting mechanism 11*b*. A brake 11*d* is disposed not on the driving motor 11*a*, but on an input shaft 11*e* of the reduction gears 11*c*.

As shown in FIG. 5, the chain rollers 13*e* are disposed on the right and left sides of the chain link 13*a*. The rails for circulation 14 on which the chain rollers 13*e* are rotated are disposed on the right and left sides of the circulating chain 13 corresponding to the layout of the chain link 13*a*. As shown in FIG. 5, one chain roller 13*e*' of the chain rollers 13*e* is positioned such that the chain roller 13*e*' overlaps with the step chain 4, while the other chain roller 13*e*" of the chain rollers 13*e* is positioned such that the chain roller 13*e*" is positioned outside a projection plane 13*f* of the step chain 4 so as not to overlap with the same.

The respective driving sprocket 12 and the driven sprocket 15 have tooth spaces each of which is formed into a shape engageable with the chain link 13*a* of the circulating chain 13, i.e., a shape corresponding to the bypassing shape of the chain link 13*a*.

Each of the circulating chain 13 has the even number of hinges 13*b*. As shown in FIG. 6, the adjacent chain links 13*a* of the circulating chain 13 are overlappingly connected to each other in a staggered manner such that ends of the adjacent chain links 13*a* are rotatable on the hinges 13*b*. An assisting link 13*a*' of a shape corresponding to the chain link 13*a* is overlapped with one of the adjacent chain links 13*a* so as to improve durability of the hinges 13*b*. The driving sprocket 12 and the driven sprocket are formed by overlapping plate teeth 12*a* and plate teeth 15*a*, respectively. The respective plate teeth 12*a* and 15*a* have substantially the same thickness as that of the chain link 13*a*, and are configured to be sequentially, alternately engaged with the chain links 13*a*. In this embodiment, the driving sprocket 12 and the driven sprocket 15 are formed by overlapping three plate teeth 12*a* and three plate teeth 15*a*, respectively, to correspond to the three links in the circulating chain 13, i.e., the two adjacent chain links 13*a* and the one assisting link 13*a*'.

The number of chain links 13*a* of the circulating chain 13 is different from a multiple of the positioning cycle number of the certain step rollers to be engaged with the steps 5 out of the step rollers 4*b*. That is to say, when the step rollers positioned at every (n) number of the step rollers 4*b* are engaged with the steps 5, the number of the chain links 13*a* of the circulating chain 13 is different from a multiple of the number (n). To be specific, in the example shown in FIG. 2(*a*), since the step rollers positioned at every three step rollers 4*b* are engaged with the steps 5, the number of the chain links 13*a* of the circulating chain 13 is 22, which is larger than a multiple of 3 by 1.

Next, an operation of this embodiment is described.

In FIGS. 1 and 2, the driving sprocket 12 is driven by a driving force of the rotating and driving unit 11 of the chain driving mechanism 10. In accordance with the rotational movement of the driving sprocket 12, the circulating chain 13 disposed between the upper and lower step chains 4 is circulatingly moved. Due to the circulating movement of the circulating chain 13, a thrust is given to the step chain 4. Further, as shown in FIG. 1, since a thrust is given to the step chains 4, the plurality of steps 5 connected to the step chain 4 are moved along the step guide rail 3.

In addition to the above basic operation of the conveyor apparatus 1, the conveyor apparatus 1 in this embodiment has the following operations.

As described above, the chain link 13*a* of the circulating chain 13 includes the placing surface 13*c* between the right and left hinges 13*b*, on which the step roller 4*b* is placed, and the pressing surfaces 13*d* and 13*d* that are in contact with the step rollers 4*b*' and 4*b*" on the front and rear sides of the step roller 4*b*. Owing to the structure of the circulating chain 13, even when the general step chain 4 is driven, a driving force can be given thereto while maintaining a deep meshing of the step chain 4 and the circulating chain 13.

That is to say, as shown in FIG. 7, in this embodiment, a meshing angle $\alpha$ can be made relatively small. Unless the chain link 13*a* has such pressing surfaces 13*d*, meshing is confined at a meshing angle $\beta$ of the placing surface 13*c*. A condition of this meshing angle can be geometrically determined, taking into consideration that, when the circulating chain 13 is circulated to come into contact with the step chain 4 and to take apart therefrom, the hinge 13*b*" is rotated about the hinge 13*b*' which is in contact with the step chain 4. Since the hinge 13*b* of the circulating chain 13 is disposed between the step rollers 4*b* of the step chain 4, and the chain link 13*a* has a shape that bypasses the step roller 4*b*, it is possible to give a driving force while maintaining a further deeper meshing angle $\alpha$ (smaller angle $\alpha$).

In the chain driving mechanism 10 shown in FIG. 2, the circulating chain 13 is guided by the chain rollers 13*e* disposed on the hinges 13*b*, along the circulation path of the rail for circulation 14. As described above, the rail for circulation 14 defines a path formed by the pair of arcuate parts 14*a* and 14*a* and the pair of linear parts 14*b* and 14*b*. The inclined surfaces 14*c* as connecting parts for preventing vibration of the circulating chain is interposed between the respective arcuate parts 14*a* and the linear parts 14*b*. Thus, in the conveyor apparatus in this embodiment, even when a conveyor chain of relatively a longer link is used as the step chain 4, and the circulating chain 13 of a long link engageable with the step chain 4 are driven by a general sprocket, the circulating chain 13 and the step chain 4 are free of pulsing motion.

Further, since the driven sprocket 15 as a counterpart of the driving sprocket 12 is rotatably disposed on one of the arcuate part 14*a* of the rail for circulation 14, movements of the right and left circulating chains 13 can be synchronized. Furthermore, since the handrail belt clamped by a plurality of rollers is driven by the handrail belt driving unit 16 to which a driving force is given by the shaft 15*b* of the driven sprocket 15, the handrail belt can be driven in conjunction with the steps 5.

On the other hand, as shown in FIG. 3, since the handrail belt is directly driven by the roller 16*b* of a larger diameter of the handrail belt driving unit 16 to which a driving force is given by the shaft 15*b* of the driven sprocket 15, the handrail belt can be driven in conjunction with the steps 5. Either of the general handrail belt driving units shown in FIGS. 2 and 3 may be driven.

As shown in FIGS. 3 and 4, since the rotating and driving unit 11 includes the driving motor 11*a*, the transmitting mechanism 11*b* formed of a belt for transmitting a rotational torque of the driving motor 11*a* to the respective right and left driving sprockets 12, and the reduction gears 11*c* disposed on a center of each driving sprocket 12 for amplifying a rotational torque transmitted from the transmitting mechanism 11*b*, a torque transmitted from the driving motor 11*a* to the reduction gears 11*c* is small. Thus, sizes of the mechanisms such as the driving motor 11*a* and the transmitting mechanism 11*b*, including the brake 11*d*, can be reduced. As described above, since a torque transmitted from the driving motor 11*a* to the reduction gears 11*c* is small, a belt is used as the transmitting mechanism 11*b* whereby no meshing noise is generated. In addition, since the brake 11*d* is positioned on a downstream side of the transmitting mechanism 11*b* (belt), if the transmitting mechanism 11*b* (belt) has some trouble to run off its track, the driving sprockets 12 can be stopped by the brake 11*d*.

As shown in FIG. 5, since the chain rollers 13*e* are disposed on the right and left sides of the chain link 13*a*, and the rails for circulation 14 on which the chain rollers 13*e* are rotated are disposed on the right and left sides of the circulating chain 13 corresponding to the layout of the chain link 13*a*, the circulating chain 13 is supported and guided by the right and left chain rollers 13*e* along the rails for circulation 14, so that the circulating chain 13 can be circulated in a stable state. Moreover, since one chain roller 13*e*' of the chain rollers 13*e* is positioned such that the chain roller 13*e*' overlaps with the step chain 4, while the other chain roller 13*e*" of the chain rollers 13*e* is positioned such that the chain roller 13*e*" is positioned outside a projection plane 13*f* of the step chain 4 so as not to overlap with the same, it is possible to deeply mesh the circulating chain 13 with the step chain 4.

Since the respective driving sprocket 12 and the driven sprocket 15 have tooth spaces each of which is formed into a shape engageable with the chain link 13*a* of the circulating chain 13, i.e., a shape corresponding to the bypassing shape of the chain link 13*a*, the chain rollers 13*e* are not involved in a meshing of the driving sprocket 12 and the driven sprocket 15 with the circulating chain 13, and the circulating chain 13 can be circulated in a stable state while the chain rollers 13*e* are supported by the rail for circulation 14 throughout its path.

In addition, the adjacent chain links 13*a* of the respective circulating chain 13 of the chain driving mechanism 10 are overlappingly connected to each other in a staggered manner. The driving sprocket and the driven sprocket 15 are formed by overlapping the plate teeth 12*a* and the plate teeth 15*a*, respectively. The plate teeth 12*a* and 15*a* each have substantially the same thickness as that of the chain link 13*a*. The respective plate teeth 12*a* and 15*a* are configured to be sequentially, alternately engaged with the chain links 13*a*. Namely, in FIG. 5, a width T where the circulating chain 13 and the step chain 4 are overlapped with each other is a sum of a product given by multiplying the thickness t of the chain link 13*a* by two and the thickness t' of the chain roller 13*e*, i.e., 2t+t'. Thus, a part where the circulating chain 13 and the step chain 4 are overlapped with each other can be made thinner.

Moreover, the driving sprocket 12 and the driven sprocket 15 have three plate teeth 12*a* and three plate teeth 15*a*, respectively. As shown in FIG. 6, since the circulating chain 13 has the assisting link 13*a*' which are engageable with tooth spaces of the plates 12*a* and 15*a* of the driving sprocket 12 and the driven sprocket 15 together with the chain links 13*a*, generation of bending moment caused by a cantilever action at the hinge 13*b* can be prevented.

The number of chain links 13*a* of the circulating chain 13 is 22, which is larger than 21 by 1, the number 21 being a multiple number of 3 which is a positioning cycle number of the step rollers 4*b*. Thus, every time when the circulating chains 13 make a round, the chain links 13*a* on which the step rollers 4*b* engaged with the steps 5 are placed are shifted. Thus, there is no possibility that load is intensively applied to the certain chain links 13*a*, whereby local abrasion of the circulating chains 13 can be prevented.

In this embodiment, as shown in FIG. 2, the chain link 13*a* has the pressing surfaces 13*d* and 13*d* that are in contact with step rollers 4*b*' and 4*b*" on the front and rear sides of the step roller 4*b*. Thus, even when the general step chain 4 is driven, a driving force can be given thereto while maintaining a deep meshing of the step chain 4 and the circulating chain 13. Accordingly, since floating of the step roller 4*b* can be prevented, a mechanism for preventing floating is dispensable. If such a mechanism is required for safety, a mechanism of a simple structure is sufficient.

In this embodiment, as shown in FIG. 7, due to the provision of the hinge 13*b* of the circulating chain 13 between the step rollers 4*b* of the step chain 4, a driving force can be given to the step chain 4 while maintaining the deeper meshing angle α. Thus, the above floating prevention effect can be more enhanced.

In this embodiment, as shown in FIG. 2, in the chain driving mechanism 10, the rail for circulation 14 defines a path formed by the pair of arcuate parts 14*a* and 14*a* and the pair of linear parts 14*b* and 14*b*. The inclined surfaces 14*c* as connecting parts for preventing vibrations of the circulating chain is interposed between the respective arcuate part 14*a* and the linear part 14*b*, whereby generation of pulsing motions in the circulating chain 13 can be prevented. As a result, the driven step chain 4 can be free of pulsing motion, which results in a comfortable ride quality on the steps 5.

In this embodiment, the driven sprocket 15 which is a counterpart of the driving sprocket 12 is rotatably disposed on one arcuate part 14*a* of the rail for circulation 14 to synchronize movements of the right and left circulating chains 13. Thus, there is no possibility that the movements of the right and left step chains 4 are deviated from each other to invite an unstable situation, and a safety can be ensured.

In this embodiment, as shown in FIG. 3, since the handrail belt is directly driven by the roller 16*b* of a larger diameter of the handrail belt driving unit 16 to which a driving force is given by the shaft 15*b* of the driven sprocket 15, the handrail belt can be driven in conjunction with the steps 5. Thus, there is no possibility that a movement of the handrail belt becomes slower than a movement of the step 5 to cause a passenger to topple, and a safety can be guaranteed. Further, this embodiment can be widely used because either of the general handrail driving units shown in FIGS. 2 and 3 can be driven.

In this embodiment, as shown in FIG. 3, in the rotating and driving unit 11, the reduction gears 11*c* for amplifying a transmitted rotational torque is disposed on a center of each driving sprocket 12. Thus, a torque transmitted to the reduction gears 11*c* is small, and dimensions from the driving motor 11*a* to the transmitting mechanism 11*b* are small. Thus, as shown in FIG. 4, the rotating and driving unit 11 can be disposed in a narrow space between the going step 5' and the returning step 5", and a structure of the rotating and driving unit 11 can be easily made smaller. As described above, since a torque transmitted to the reduction gears 11*c* is small, a belt can be used as the transmitting mechanism 11*b*. Thus, there is no meshing noise, and calmness can be acquired. In addition, since the brake 11*d* is positioned on the downstream side of the transmitting mechanism 11*b* (belt), if the transmitting mechanism 11*b* (belt) has some trouble to run off its track, the driving sprockets 12 can be stopped by the brake 11*d*, and a safety can be maintained.

In this embodiment, as shown in FIG. 5, the chain rollers 13*e* are disposed on the right and left sides of the chain link 13*a* so as to circulate the circulating chains 13 in a stable state along the rails for circulation 14. Thus, if a force caused by an excessive load or an earthquake is applied in an unexpected direction, each circulating chain 13 can keep its stable state, and a safety can be retained. In addition, one chain roller 13*e*' of the chain rollers 13*e* is positioned such that the chain roller 13*e*' overlaps with the step chain 4, while the other chain roller 13*e*" of the chain rollers 13*e* is positioned such that the chain roller 13*e*" is positioned outside a projection plane 13*f* of the step chain 4 so as not to overlap with the same, in order that the circulating chain 13 can be meshed deeply with the step chain 4. Thus, a mechanism for preventing floating is dispensable. If such a mechanism is required for safety, a mechanism of a simple structure is sufficient.

In this embodiment, since the chain rollers 13*e* are not involved in a meshing of the driving sprocket 12 and the driven sprocket 15 with the circulating chain 13, and the circulating chain 13 can be circulated in a stable state while the chain 35 rollers 13*e* are supported by the rail for circulation 14 throughout its path. Thus, if a force caused by an excessive load or an earthquake is applied in an unexpected direction, each circulating chain 13 can keep its stable state, and a safety can be retained.

In this embodiment, the driving sprocket 12 and the driven sprocket 15 are formed by overlapping the plate teeth 12*a* and the plate teeth 15*a* each having substantially the same thickness as that of the chain link 13*a*. A part where the chain links 13*a* are overlapped with each other is made substantially equal to the width of the pressing surface 13*d*. Thus, the circulating chain 13 can be made thinner to save space.

In this embodiment, the driving sprocket 12 and the driven sprocket 15 are formed by overlapping the three plate teeth 12*a* and the three plate teeth 15*a*, respectively. The circulating chain 13 has the two adjacent chain links 13*a* and the one assisting link 13*a*' which are engageable with the three plate teeth 12*a* and 15*a* of the respective driving sprocket 12 and the driven sprocket 15. Thus, generation of bending moment caused by a cantilever action at the hinge 13*b* can be prevented and durability of the circulating chain 13 can be enhanced.

In this embodiment, every time when the circulating chain 13 makes a round, the chain links 13*a* on which the step rollers 4*b* engaged with the steps 5 are placed are shifted. Since a load is not intensively applied to the certain chain links 13*a*, local abrasion of the circulating chain 13 can be prevented so that durability of the chain driving mechanism 10 can be improved.

In this embodiment, as shown in FIG. 8, for example, a rotating and driving unit 11' may be used in place of the rotating and driving unit 11. The rotating and driving unit 11' includes the driving motor 11*a* provided with the brake 11*d*, a reduction gear 11*c*' disposed in a center part, for amplifying a rotational torque of the driving motor 11*a*, and transmitting mechanisms 11*b*' for transmitting the amplified rotational torque to the respective right and left driving sprockets 12.

In this case, the transmitting mechanisms 11*b*' for transmitting the amplified rotational torque to the respective right and left driving sprockets 12 have to be made robust, and sizes of the mechanisms from an output side of the reduction gear 11*c*' disposed in the center part to the transmitting mechanisms 11*b*' are large. Thus, restrictions in terms of space become strict. However, since the number of reduction gear 11*c*' can be reduced to one, and the driven sprocket 15 can be omitted by mounting the handrail belt driving unit 16 directly on the driving sprocket 12, an inexpensive structure can be achieved. Further, since the handrail belt driving unit 16 is directly mounted on the driving sprocket 12, no excessive load for driving the handrail belt is applied to the circulating chain 13, which entails improvement in durability of the circulating chain 13.

Second Embodiment

Figure 11:
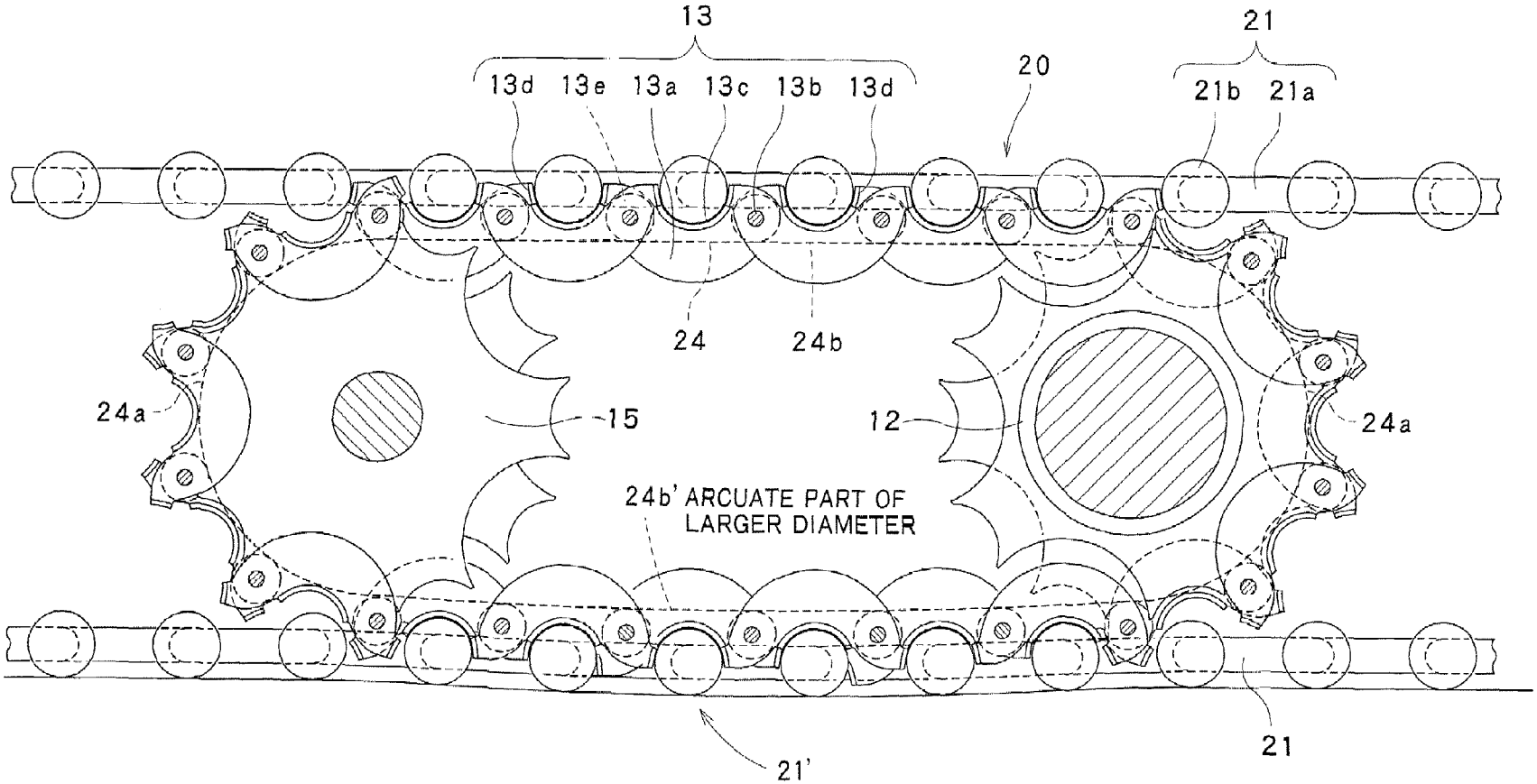
FIG. 11 is a side view of a chain driving mechanism of a conveyor apparatus in a second embodiment of the present invention.
Figure 12:
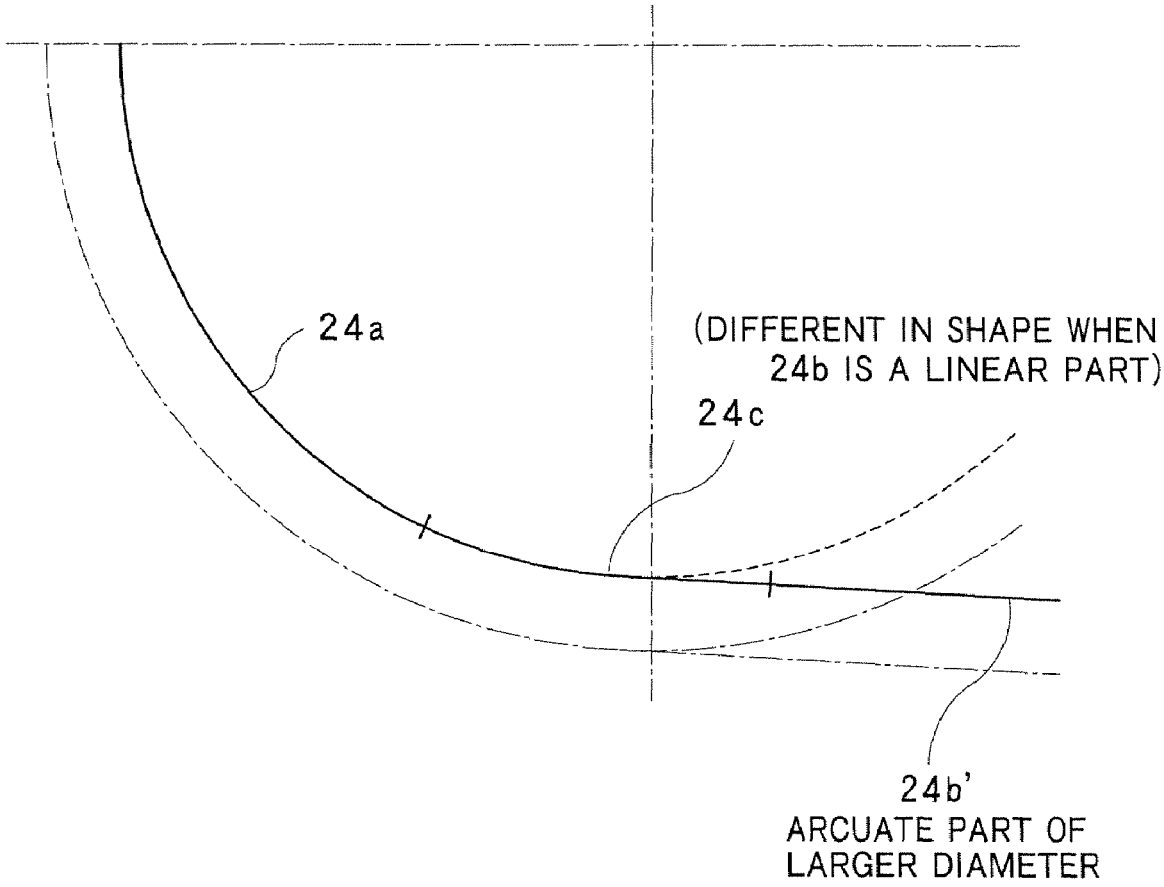
FIG. 12 is an enlarged view of a part of a rail for circulation.

Next, a second embodiment of the present invention is described with reference to FIGS. 11 and 12. FIG. 11 is a side view of a chain driving mechanism of a conveyor apparatus in a second embodiment of the present invention. FIG. 12 is an enlarged view of a part of a rail for circulation.

The second embodiment shown in FIGS. 11 and 12 differs from the first embodiment in that a step chain 21 is provided with a sectoral part 21' of a larger curvature radius, but other structures and effects are substantially the same as those of the first embodiment. In FIGS. 11 and 12, the same parts as those in the first embodiment shown in FIGS. 1 to 10 are depicted by the same reference numbers, and the detailed description thereof is omitted.

At first, a schematic structure of the conveyor apparatus in this embodiment is described with reference to FIG. 11.

As shown in FIG. 11, the step chain 21 includes a step links 21*a* and step rollers 21*b*. Each of circulating chains 13 is disposed between a sprocket 12 and a driven sprocket 15 and the step chain 21 to be circulated in accordance with a rotational movement of the driving sprocket 12 and the driven sprocket 15 to give a thrust to the step chain 21.

Similar to the first embodiment, each of the circulating chains 13 has the plurality of chain links 13*a* and hinges 13*b* to be connected to the adjacent chain links 13*a*. A pitch length of the chain link 13*a* is equal to a pitch length of the step link 21*a*. The chain link 13*a* includes a placing surface 13*c* on which the step roller 21 is placed, and pressing surfaces 13*d* and 13*d* that are in contact with the step rollers 21*b* on front and rear sides of the step roller 21*b* placed on the placing surface 13*c*. The placing surface 13*c* of the chain link 13*a* is formed into a curved shape corresponding to a circumferential surface of a step roller 4*b*. In addition, the chain link 13*a* has a shape that bypasses the step roller 21*b* when the step roller 21*b* is placed on the placing surface 13*c*.

In this embodiment, the sectoral part 21' of a larger curvature radius is formed on a path at a position where a chain driving mechanism 20 of the step chain 21 is disposed. A rail for circulation 24 includes a pair of arcuate parts 24*a*, one linear part 24*b*, and one arcuate part 24*b*' of a larger diameter having a shape corresponding to the sectoral part 21'. Inclined surfaces 24*c* as connecting parts for preventing vibrations of the circulating chain 13 are interposed between the respective arcuate parts 24*a* and the linear part 24*b*, and between the respective arcuate parts 24*a* and the arcuate part 24*b*' of a larger diameter (see, FIG. 12). In FIG. 12, the inclined surface 24*c* interposed between the arcuate part 24*a* and the linear part 24*b*, and the inclined surface 24*c* interposed between the arcuate part 24*a* and the arcuate part 24*b*' of a larger diameter differ from each other in shape. The shape of the arcuate part 24*a* in the rail for circulation 24 that guides the circulating chain 13 is identical to the arcuate part 14*a* in the first embodiment. In place of the linear part 14*b* on the returning side (lower side in FIG. 2) in the first embodiment, the arcuate part 24*b*' of a larger diameter corresponding to the sectoral part 21' is formed.

That is to say, the shape of the inclined surface 24*c* connecting the driving sprocket 12 and the arcuate part 24*b*' of a larger diameter to each other, and the shape of the inclined surface 24*c* connecting the driven sprocket 15 and the arcuate part 24*b*' of a larger diameter to each other (or the shape of the inclined surface 24*c* connecting the arcuate part 24*a* and the arcuate part 24*b*' of a larger diameter, when the driven sprocket 15 is omitted) are substantially identical to those shown in FIG. 20 of JP2005-47182A.

Next, an operation of this embodiment is described.

In the chain driving mechanism 20 shown in FIG. 11, the step chain 21 is raised toward an inside of the sectoral part 21' (upper side in FIG. 11) by a tensile force F of the step chain 21, so that the step chain 21 is urged against the circulating chain 13.

In this case, since there are interposed the inclined surfaces 24*c* as connecting parts for preventing vibrations of the circulating chain 13, between the respective arcuate parts 24*a* and the linear part 24*b*, and between the respective arcuate parts 24*a* and the arcuate part 24*b*' of a larger diameter, generation of pulsing motion in the circulating chain 13 can be prevented, so that the step chain 21 can be free of pulsing motion. This effect is similarly obtained when a conveyor chain of relatively a long link is used as the step chain 21 and the circulating chain 13 of a long link to be engageable with the step chain 21 is driven by the driving sprocket 12 with a less number of teeth.

The conveyor apparatus in this embodiment produces the following effects.

Firstly, as shown in FIG. 9, since the sectoral part 21' of a larger curvature radius is formed on a path at a position where the chain driving mechanism 20 of the step chain 21 is disposed, the step chain 21 is pressed against the circulating chain 13. Thus, a mechanism for preventing floating of the step chain 21 is dispensable. If required, a mechanism of a simple structure is sufficient.

The rail for circulation 24 includes the pair of arcuate parts 24*a*, the linear part 24*b*, and the arcuate part 24*b*' of a larger diameter having a shape corresponding to the sectoral part 21'. Since there are interposed the inclined surfaces 24*c* as connecting parts for preventing vibrations of the circulating chain 13, between the respective arcuate parts 24*a* and the linear part 24*b*, and between the respective arcuate parts 24*a* and the arcuate part 24*b*' of a larger diameter, generation of pulsing motion in the circulating chain 13 can be prevented. Thus, the driven step chain 21 can be free of pulsing motion, to thereby improve a riding quality on steps 5.

In this embodiment, since the shape of the chain link 13*a* has the pressing surfaces 13*d* that are in contact with front and rear step rollers 21*b*, even when the general step chain 21 is driven, a driving force can be given thereto while maintaining a deep meshing angle.

In this embodiment, there are interposed the inclined surfaces 24*c* as connecting parts for preventing vibrations of the circulating chain 13, between the respective arcuate parts 24*a* and the linear part 24*b*, and between the respective arcuate parts 24*a* and the arcuate part 24*b*' of a larger diameter. Thus, even when a conveyor chain of relatively a long link is used as the step chain 21 and the circulating chain 13 of a long link to be engageable with the step chain 21 are driven by a general sprocket, no pulsing motion is generated in the circulating chain 13. Thus, the driven step chain 21 can be free of pulsing motion, to thereby improve a riding quality on the steps 5.

Third Embodiment

Next, a third embodiment of the present invention is described with reference to FIGS. 13 to 15.

Figure 13:
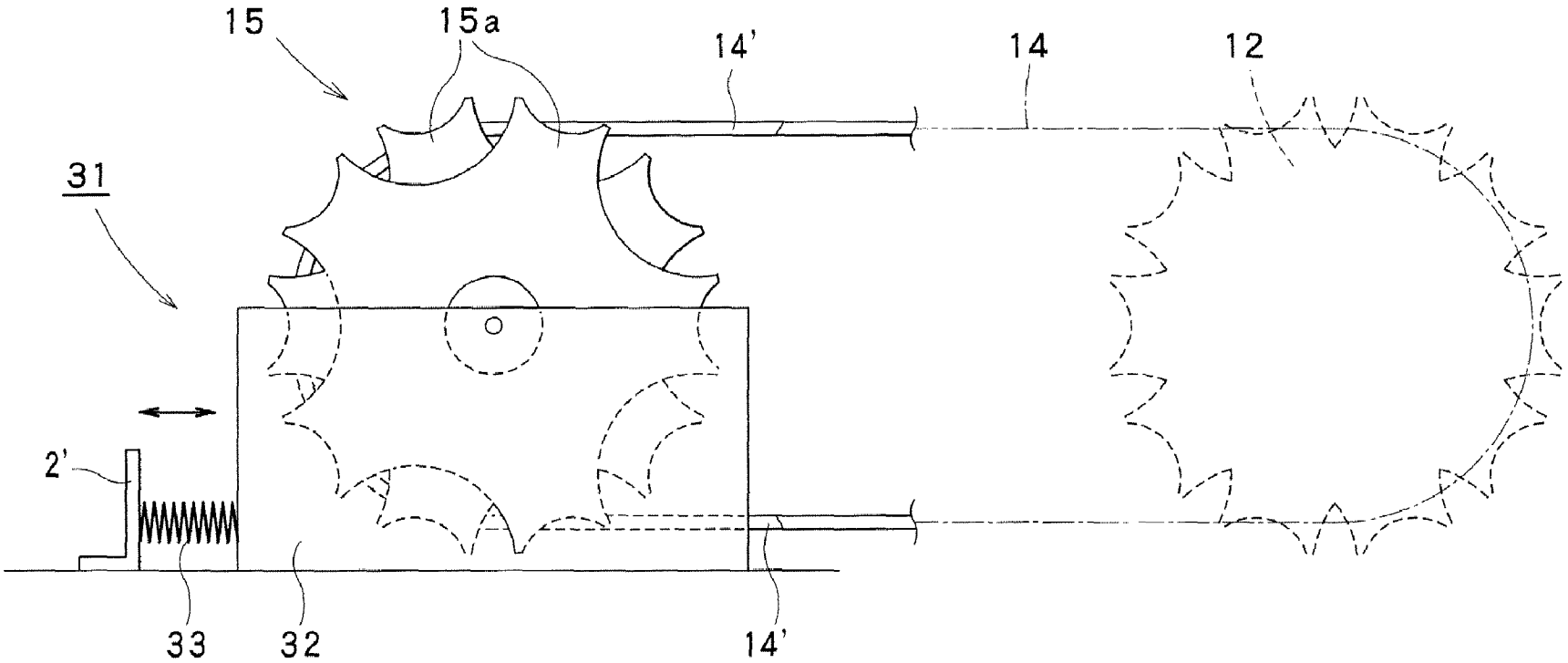
FIG. 13 is a schematic view of a tensioner mechanism disposed on a chain driving mechanism of a conveyor apparatus in a third embodiment of the present invention.

FIG. 13 is a schematic view of a tensioner mechanism disposed on a chain driving mechanism of a conveyor apparatus in a third embodiment of the present invention. FIG. 14 is a side view of a driving sprocket (driven sprocket) of the chain driving mechanism. FIG. 15 is a front sectional view of a part near circulating chain of the chain driving mechanism. In the third embodiment, as shown in FIG. 13, there is additionally disposed a tensioner mechanism 31 for moving a driven sprocket 15 of a chain driving mechanism 10 in a direction close to and apart from a driving sprocket 12, so as to adjust a tensile force of the circulating chain 13. In the third embodiment, as shown in FIG. 14, a margin gap dp for promoting disengagement of a chain link 13*a* is disposed in each of the tooth spaces formed in plate teeth 12*a* (15*a*) of the driving sprocket 12 (and the driven sprocket 15) to be engaged with the chain link 13*a* of the circulating chain 13. In addition, there are formed common holes 34 passing through the plate teeth 12*a* (15*a*) in a thickness direction at positions where the tooth spaces of the respective plate teeth 12*a* (15*a*) intersect with each other. An integral buffer material 35 is buried in each of the common holes 34. Further, in the third embodiment, at a start position and a finish position of a region (thrust transmitting region) where the circulating chain 13 of the chain driving mechanism 10 travels side by side with a step chain 4 to give a thrust thereto, a load applied to the step chain 4 is shared and supported by both a step guide rail 3 and the circulating chain 13 (hereinafter such a position is referred to as a connecting point between the step guide rail 3 and the circulating chain 13). An assisting rail 36 to be in contact with step link 4*a* of the step chain 4 for supporting a part of a load applied to the step chain 4 is disposed on the step guide rail 3 at a position of the connecting point of the step guide rail 3 and the circulating chain 13. Furthermore, in the thrust transmitting region where the circulating chain 13 and the step chain 4 travel side by side, the step rollers 4*b* of the step chain 4 are separated from the step guide rail 3 so as not to rotate on the step guide rail 3. Other structures and effects are the same as those of the first embodiment. Herebelow, the same parts as those in the first embodiment are depicted by the same reference numbers, and the detailed description of the invention thereof is omitted. Only the characteristic features of this embodiment are described below.

As shown in FIG. 13, the tensioner mechanism 31 has a support base 32 for rotatably supporting the driven sprocket 15 of the chain driving mechanism 10. The support base 32 is connected to a bracket 2' secured on a structure 2 by means of a resilient member such as a tension spring 33. Movement of the support base 32 in a width (right and left) direction is restricted by a guide, not shown. By the action of a resilient member such as the tension spring 33, the support base 32 can be moved only in a direction where the circulating chain 13 is moved, namely, in a direction close to and apart from the driving sprocket 12. A part on a side of the driven sprocket 15 of a rail for circulation 14 for guiding the circulation chain 13 along a circulation path provides a movable rail 14' which is capable of sliding relative to other part. The movable rail 14' and the driven sprocket 15 are supported by the support base 32.

For example, when a tensile force of the circulating chain 13 is excessively increased by a load applied to the circulating chain 13, and a tensile force of the circulating chain 13 is decreased because of a slack caused by a long usage, the tensioner mechanism 31 moves the support base 32 by a balance between the tensile force and an urging force of a resilient member such as the tension spring 33 so as to move the driven sprocket 15 supported on the support base 32 in a direction close to and apart from the driving sprocket 12, whereby the tensile force of the circulating chain 13 can be adjusted. Since the movable rail 14' of the rail for circulation 14 is supported by the support base 32 along with the driven sprocket 15, the movable rail 14' is moved along with the driven sprocket 15, so that a relative positional relationship between the movable rail 14' and the driven sprocket 15 is maintained. At this time, since the movable rail 14' do not separate from the other part of the rail for circulation 14, but slides thereon, a rolling surface of the rail for circulation 14 is allowed to be continuous. Boundary parts between the movable rail 14' of the rail for circulation 14 and the other part thereof are obliquely formed. Thus, the chain rollers 13*e* of the circulating chain 13 can smoothly rotate on the boundary parts.

As described above, the driving sprocket 12 and the driven sprocket 15 of the chain driving mechanism 10 are formed by overlapping three plate teeth 12*a* (15*a*) having tooth spaces engageable with the chain links 13*a* of the circulating chain 13. The tooth spaces of the respective plate teeth 12*a* (15*a*) are formed so as to be arranged in a circumferential direction of the driving sprocket 12 and the driven sprocket 15 to correspond to a chain pitch of the circulating chain 13. Basically, the tooth space in the respective plate teeth 12*a* (15*a*) is formed into a shape corresponding to the chain link 13*a* of the circulating chain 13. However, as shown in FIG. 14, the margin gap dp is disposed in a pitch direction of the circulating chain 13. The margin gap dp in each tooth space promotes drawing of the chain link 13*a* of the circulating chain 13 from the tooth space at a position where the chain link 13*a* is disengaged from the tooth space. The gap dp is set at an optimum value which is calculated based on experiments.

Figure 14:
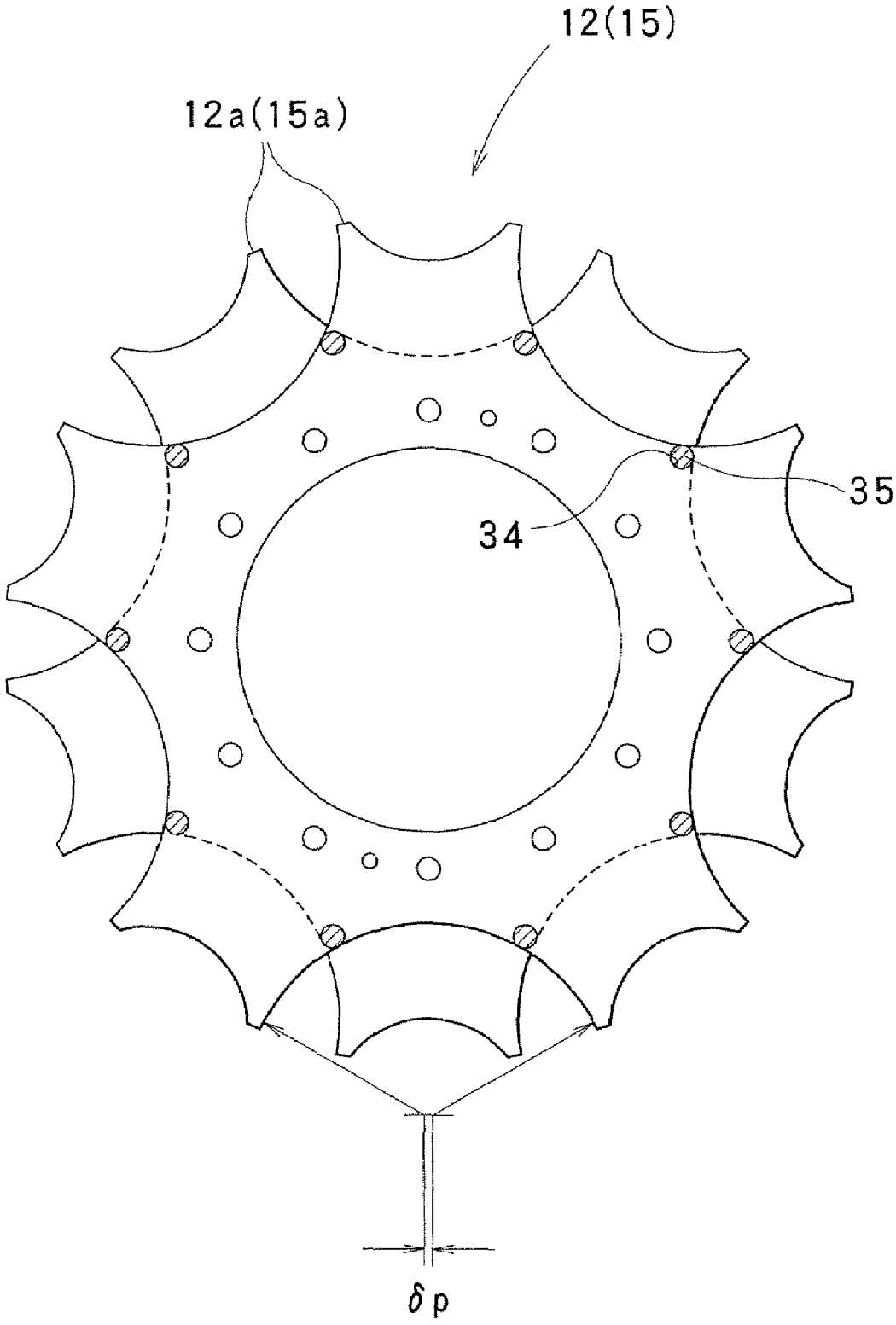
FIG. 14 is a side view of a driving sprocket (driven sprocket) of the chain driving mechanism of the conveyor apparatus in the third embodiment of the present invention.

As shown in FIG. 14, the driving sprocket 12 and the driven sprocket 15 have common holes 34 successively passing through in a thickness direction of the respective plate teeth 12*a* (15*a*) at positions where the tooth spaces of the respective plate teeth 12*a* (15*a*) intersect with each other. The integral buffer material 35 is buried in the common holes 34, i.e., through all the plate teeth 12*a* (15*a*). A function of the buffer material 35 is to help smooth meshing of the chain links 13*a* of the circulating chain 13 and the tooth spaces, when they are engaged with each other.

As described above, the circulating chain 13 of the chain driving mechanism 10 travels side by side with the step chain 4 to give a thrust thereto, while the step rollers 4*b* of the step chain 4 are placed on the placing surfaces 13*c* of the chain links 13*a*. At the start position and the finish position of the region where a thrust is transmitted from the circulating chain 13 to the step chain 4, that is, at the connecting points between the step guide rail 3 and the circulating chain 13, a load applied to the step chain 4 is shared and supported by both the step guide rail 3 and the circulating chain 13.

Figure 15:
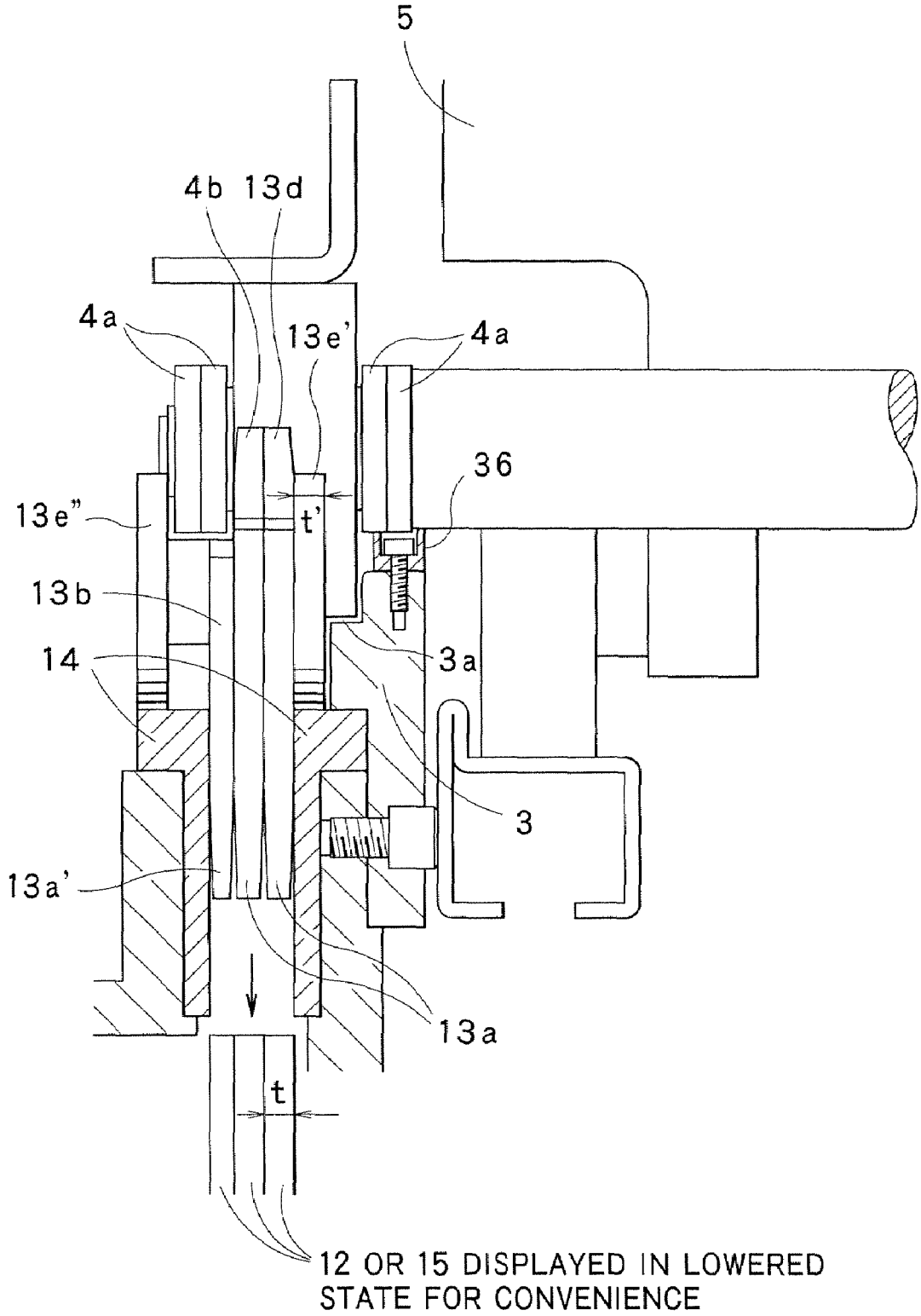
FIG. 15 is a front sectional view of a part near a circulating chain of the chain driving mechanism of the conveyor apparatus in the third embodiment of the present invention.
Figure 16:
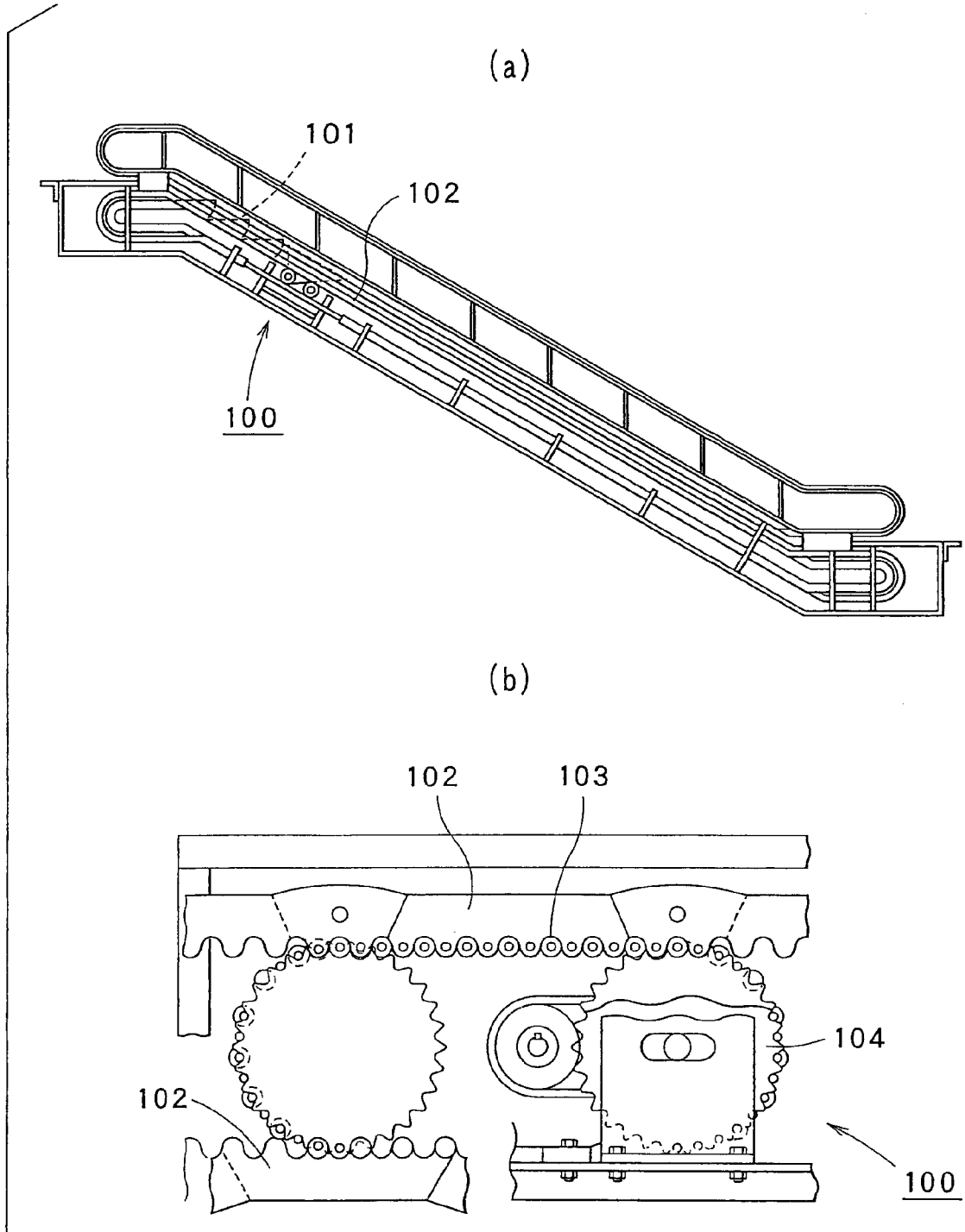
FIG. 16 Background Art
FIG. 16 is a view of a conventional conveyor apparatus.

At the connecting point where a load applied to the step chain 4 is shared and supported by the step guide rail 3 and the circulating chain 13, as shown in FIG. 15, the assisting rail 36 made of, e.g., a resin material is disposed on the step guide rail 3. The assisting rail 36 contacts the step link 4*a* of the step chain 4 to support a part of a load applied to the step chain 4. Namely, at the connecting point between the step guide rail 3 and the circulating chain 13, the step links 4*a* of the step chain 4 slide on the assisting rail 36 disposed on the step guide rail 3, and a part of a load applied to the step chain 4 is supported by the assisting rail 36. In addition, in the thrust transmitting region where the circulating chain 13 and the step chain 4 travel side by side, as show in FIG. 15, a clearance is formed between a rolling surface 3*a* of the step guide rail 3 and the step rollers 4*b*, for example, so that the step rollers 4*b* of the step chain 4 are separated from the step guide rail 3 so as not to rotate on the step guide rail 3.

In either of the examples shown in FIGS. 5 and 15, one chain roller 13*e*' of the chain rollers 13*e* is positioned outside the projection plane of the step chain 4 so as not to overlap with the same. However, in the example shown in FIG. 5, the chain roller 13*e*' is positioned outside the projection plane on an inner side, while in the example shown in FIG. 15, the chain roller 13*e*' is positioned outside the projection plane on an outer side. Such a design change can be suitably done at a designer's discretion.

Next, an operation of this embodiment is described.

In this embodiment, as shown in FIG. 13, since the chain driving mechanism 10 is provided with the tensioner mechanism 31, a tensile force of the circulating chain 13 can be autonomously adjusted so that there is no possibility that a slack of the circulating chain 13 remains at one position. Thus, even when the circulating chain 13 becomes slack because of aged deterioration, a safe circulating condition can be maintained. In addition, even when a load transmitted from the step chain 4 to the circulating chain 13 is temporarily increased by, e.g., a number of passengers, a tensile force of the circulating chain 13 can be prevented from being excessively increased, whereby damage to the circulating chain 13 can be suppressed.

When a tensile force of the circulating chain 13 is adjusted by the tensioner mechanism 31, the movable rail 14' of the rail for circulation 14 is moved in cooperation with the driven sprocket 15. Thus, a relative positional relationship between the movable rail 14' and the driven sprocket 15 is maintained, so that the circulating chain 13 is constantly, suitably guided by the rail for circulation 14 until the circulating chain 13 is meshed with the driven sprocket 15. Thus, the above-described effect of the rail for circulation 14 preventing pulsing motion of the circulating chain 13 is not spoiled.

As shown in FIG. 14, since the margin gap dp for promoting disengagement of the chain link 13*a* of the circulating chain 13 is disposed in the tooth spaces of the driving sprocket 12 and the driven sprocket 15. Thus, it can be prevented that the circulating chain 13 is tightly fitted in the driving sprocket 12 and the driven sprocket 15, to thereby inhibit a rotational movement of the driving sprocket 12 and the driven sprocket 15 and a circulation movement of the circulating chain 13.

The coaxial common holes 34 are formed in the overlapped plate teeth 12*a* (15*a*) of the driving sprocket 12 and the driven sprocket 15, and the buffer material 35 is buried in the common holes 34. Thus, when the chain links 13*a* of the circulating chain 13 and the tooth spaces of the driving sprocket 12 and the driven sprocket 15 are engaged with each other, meshing of the chain links 13*a* with the tooth spaces can be made smooth by such a simple and inexpensive structure.

At the connecting point between the step guide rail 3 and the circulating chain 13, a load applied to the step chain 4 is shared and supported by both the step guide rail 3 and the circulating chain 13. Thus, the step roller 4*b* of the step chain 4 can be smoothly moved between the step guide rail 3 and the circulating chain 13. At the connecting point between the step guide rail 3 and the circulating chain 13 where a load applied to the step chain 4 is shared and supported by both the step guide rail 3 and the circulating chain 13, as shown in FIG. 15, the assisting rail 36 made of, e.g., a resin material is disposed on the step guide rail 3. Since the step links 4*a* of the step chain 4 slide on the assisting rail 36 to support a part of a load applied to the step chain 4, the step rollers 4*b* can be more smoothly and suitably moved, irrespective of a load to be applied to the step chain 4.

In the thrust transmitting region where the circulating chain 13 and the step chain 4 travel side by side, as shown in FIG. 15, the step rollers 4*b* of the step chain 4 are separated from the step guide rail 3 so as not to rotate on the step guide rail 3. Thus, the step rollers 4*b* of the step chain 4 can be securely supported and transferred by the circulating chain 13.

The conveyor apparatus in this embodiment produces the following effects.

In this embodiment, the tensioner mechanism 31 is additionally disposed on the chain driving mechanism 10 so as to autonomously adjust a tensile force of the circulating chain 13. Thus, a safe circulation of the circulating chain 13 can be maintained so as to improve durability of the apparatus.

When a tensile force of the circulating chain 13 is adjusted by the tensioner mechanism 31, the movable rail 14' of the rail for circulation 14 is moved along with the driven sprocket 15 in a direction close to and apart from the driving sprocket 12. Thus, the effect of the rail for circulation 14 preventing pulsing motion of the circulating chain 13 is not spoiled, and silence of the apparatus can be maintained.

Due to the provision of the margin gap dp in the tooth spaces of the driving sprocket 12 and the driven sprocket 15, the circulating chain 13 can be prevented from being fitted in the driving sprocket 12 and the driven sprocket 15. Thus, a smooth circulating condition of the circulating chain 13 can be maintained, and durability of the apparatus can be improved.

The common holes 34 are formed in the overlapped plate teeth 12*a* (15*a*) of the driving sprocket 12 and the driven sprocket 15, and the buffer material 35 is buried in the common holes 34, so that the chain links 13*a* of the circulating chain 13 can be smoothly meshed with the tooth spaces of the driving sprocket 12 and the driven sprocket 15. Thus, vibrations and noises of the apparatus can be reduced, whereby silence can be improved.

At the connecting point between the step guide rail 3 and the circulating chain 13, a load applied to the step chain 4 is shared and supported by the respective step guide rail 3 and the circulating chain 13, so that the step roller 4*b* can be smoothly moved between the step guide rail 3 and the circulating chain 13. Thus, no excessive load is applied to the step roller 4*b*, and durability can be improved.

The assisting rail 36 made of, e.g., a resin material is disposed on the connecting point between the step guide rail 3 and the circulating chain 13. Since the step links 4*a* of the step chain 4 slide on the assisting rail 36, the step rollers 4*b* can be more smoothly and suitably moved, irrespective of a load to be applied to the step chain 4. Thus, a load applied to the step roller 4*b* can be further reduced, and durability can be further improved.

In the thrust transmitting region where the circulating chain 13 and the step chain 4 travel side by side, the step rollers 4*b* of the step chain 4 are separated from the step guide rail 3 so as not to rotate on the step guide rail 3, but the step rollers 4*b* of the step chain 4 are securely supported and transferred by the circulating chain 13. Since an excessive force such as abrasion can be prevented from being applied to the step roller 4*b*, durability can be improved.

The invention claimed is:

1. A conveyor apparatus comprising:

a step guide rail;

a plurality of steps that move along the step guide rail;

a step chain for connecting the steps; and a chain driving mechanism for driving the step chain;

wherein the step chain has a plurality of step links and step rollers between the adjacent step links, and the chain driving mechanism includes: a rotating and driving unit; a driving sprocket connected to the rotating and driving unit to be rotated by a driving force given by the rotating and driving unit; and a circulating chain disposed between the driving sprocket and the step chain to be circulated in accordance with a rotational movement of the driving sprocket to give a thrust to the step chain;

the circulating chain has chain links and hinges to be connected to the adjacent chain links, a pitch length of the chain link being equal to or a multiple of a pitch length of the step link; and the chain link has a placing surface on which the step roller is placed, and pressing surfaces that are in contact with the step rollers on front and rear sides of the step roller placed on the placing surface.

2. The conveyor apparatus according to claim 1, wherein the chain link has a shape that bypasses the step roller when the step roller is placed on the placing surface.

3. The conveyor apparatus according to claim 1, wherein chain rollers are arranged on each of the hinges of the circulating chain such that the chain rollers are coaxially rotatable with the hinges;

a rail for circulation is disposed that is engaged with the chain rollers for guiding the circulating chain along a circulation path; and the rail for circulation defines a path formed by a pair of arcuate parts and at least one linear part, and inclined surfaces as connecting parts for preventing vibrations of the circulating chain is interposed between the respective arcuate parts and the linear part.

4. The conveyor apparatus according to claim 3, wherein a driven sprocket as a counterpart of the driving sprocket is rotatably disposed on one arcuate part of the rail for circulation.

5. The conveyor apparatus according to claim 3 or 4, wherein a sectoral part of a larger curvature radius is formed on a path at a position of the step chain where the chain driving mechanism is disposed, and the rail for circulation includes a pair of arcuate parts, a linear part, and an arcuate part of a larger diameter having a shape corresponding to the sectoral part, and inclined surfaces as connecting parts for preventing vibrations of the circulating chain is interposed between the respective arcuate parts and the linear part, and between the respective arcuate part and the arcuate part of a larger diameter.

6. The conveyor apparatus according to claim 4 further comprising a handrail belt driving unit for driving a handrail belt, wherein a coupling mechanism for transmitting a driving force from the driven sprocket is disposed between the driven sprocket and the handrail belt driving unit.

7. The conveyor apparatus according to claim 3, wherein the chain rollers are disposed on right and left sides of the chain link, and the rails for circulation on which the chain rollers are rotated are disposed on right and left sides of the circulating chain corresponding to the layout of the chain link.

8. The conveyor apparatus according to claim 7, wherein one of the chain rollers is positioned such that the one chain roller overlaps with the step chain, while the other of the chain rollers is positioned such that the other chain roller is positioned outside a projection plane of the step chain so as not to overlap with the same.

9. The conveyor apparatus according to claim 1;

wherein the rotating and driving unit includes a driving motor, a reduction gear for amplifying a rotational torque of the driving motor, and transmitting mechanisms for transmitting the amplified rotational torque to the respective right and left driving sprockets.

10. The conveyor apparatus according to claim 1;

wherein the rotating and driving unit includes a driving motor, a transmitting mechanism for transmitting a rotational torque of the driving motor to the respective right and left driving sprockets, and reduction gears disposed on a center of each driving sprocket for amplifying a rotational torque transmitted by the transmitting mechanism.

11. The conveyor apparatus according to claim 4, wherein the driving sprocket and the driven sprocket each have a shape engageable with the chain links of the circulating chain.

12. The conveyor apparatus according to claim 11, wherein the circulating chain has the even number of hinges, with the chain links of the circulating chain being overlappingly connected to each other in a staggered manner, and the driving sprocket and the driven sprocket are formed by overlapping plate teeth each having substantially the same thickness as that of the chain link, with the respective plate teeth being configured to be sequentially, alternately engaged with the chain links.

13. A conveyor apparatus comprising:

a step guide rail;

a plurality of steps that move along the step guide rail;

a step chain including a plurality of step rollers rotating on the step guide rail and a plurality of step links disposed between the respective step rollers, the step chain connecting the steps by the certain step rollers positioned at every predetermined number of the step rollers such that the certain step rollers are engaged with the steps; and a chain driving mechanism including a rotating and driving unit; a driving sprocket and a driven sprocket that are rotated by a driving force given by the rotating and driving unit, and a circulating chain disposed between the driving sprocket and the driven sprocket and the step chain to be circulated in accordance with a rotational movement of the driving sprocket and the driven sprocket to give a thrust to the step chain;

wherein the circulating chain has a plurality of chain links whose pitch length is equal to or a multiple of a pitch length of the step link, and hinges for connecting the chain links, each of the chain links has a placing surface on which the step roller is placed, the placing surface being formed into a curved shape corresponding to a circumferential shape of the step roller, and pressing surfaces that are in contact with the step rollers on front and rear sides of the step roller placed on the placing surface; and the number of the chain links is different from a multiple of the predetermined number as a positioning cycle number of the certain step rollers to be engaged with the steps.

14. The conveyor apparatus according to claim 13, wherein the chain driving mechanism is provided with a tensioner mechanism that moves the driven sprocket in a direction close to and apart from the driving sprocket to adjust a tensile force of the circulating chain.

15. The conveyor apparatus according to claim 14, wherein the circulating chain of the chain driving mechanism have chain rollers coaxially rotatable with the hinges, a rail for circulation that is engaged with the chain rollers of the circulating chain to guide the circulating chain along a circulation path is disposed; and the tensioner mechanism moves a part of the rail for circulation along with the driven sprocket to adjust a tensile force of the circulating chain.

16. The conveyor apparatus according to claim 13, wherein the respective driving sprocket and the driven sprocket of the chain driving mechanism have tooth spaces to be engaged with the chain links of the circulating chain, and the respective tooth spaces have margin gaps for promoting disengagement of the chain links.

17. The conveyor apparatus according to claim 13, wherein the respective driving sprocket and the driven sprocket of the chain driving mechanism are formed by overlapping a plurality of plate teeth provided with tooth spaces to be engaged with the chain links of the circulating chain, common holes passing in a thickness direction are formed at positions where the tooth spaces of the respective plate teeth intersect with each other, and a buffer material is buried in the common holes.

18. The conveyor apparatus according to claim 13, wherein, at a start position and a finish position of a thrust transmitting region where the circulating chain of the chain driving mechanism travel side by side with the step chain to give a thrust thereto, a load applied to the step chain is shared and supported by both the step guide rail and the circulating chain.

19. The conveyor apparatus according to claim 18, wherein, at the start position and the finish position of the thrust transmitting region, an assisting rail to be in contact with the step links of the step chain to support a part of a load to be applied to the step chain is disposed on the step guide rail.

20. The conveyor apparatus according to claim 18, wherein, in the thrust transmitting region, the step rollers of the step chain are separated from the step guide rail.

* * * * *